US008286563B2

(12) United States Patent
Low

(10) Patent No.: US 8,286,563 B2
(45) Date of Patent: Oct. 16, 2012

(54) PALLET

(75) Inventor: Eng Choon Low, Hong Kong (HK)

(73) Assignee: Eco-Block International Limited, Hong Kong (HK)

( * ) Notice: Subject to any disclaimer, the term of this patent is extended or adjusted under 35 U.S.C. 154(b) by 547 days.

(21) Appl. No.: 12/490,887

(22) Filed: Jun. 24, 2009

(65) Prior Publication Data

US 2009/0320723 A1 Dec. 31, 2009

(30) Foreign Application Priority Data

Jun. 25, 2008 (GB) ..... 0811636.0

(51) Int. Cl.
*B65D 19/26* (2006.01)

(52) U.S. Cl. ..... 108/56.3

(58) Field of Classification Search ..... 108/51.11, 108/56.1, 56.3, 57.17, 57.18, 54.1, 901, 902, 108/57.19; 206/386, 595, 597–600
See application file for complete search history.

(56) References Cited

U.S. PATENT DOCUMENTS

| | | | | | |
|---|---|---|---|---|---|
| 2,371,106 | A | * | 3/1945 | Lewis et al. | 108/57.1 |
| 2,817,485 | A | * | 12/1957 | White et al. | 108/57.1 |
| 3,878,796 | A | * | 4/1975 | Morrison | 108/56.1 |
| 3,954,067 | A | * | 5/1976 | Miles | 108/57.1 |
| 4,220,099 | A | * | 9/1980 | Marchesano | 108/57.19 |
| 5,333,555 | A | * | 8/1994 | McPhee | 108/57.19 |
| 5,365,859 | A | * | 11/1994 | Schrage | 108/56.1 |
| 5,417,167 | A | | 5/1995 | Sadr | |
| 5,440,998 | A | * | 8/1995 | Morgan et al. | 108/57.18 |
| 5,579,701 | A | * | 12/1996 | Fook Wah | 108/56.1 |
| 5,662,048 | A | | 9/1997 | Kralj et al. | |
| 6,354,228 | B1 | * | 3/2002 | McPhee et al. | 108/51.11 |
| 6,766,749 | B2 | * | 7/2004 | Lacabanne | 108/56.3 |
| 6,802,267 | B1 | * | 10/2004 | Janus | 108/56.1 |
| 6,837,170 | B2 | * | 1/2005 | Taft | 108/57.25 |
| 6,938,558 | B1 | * | 9/2005 | Peres | 108/56.3 |
| 2004/0000259 | A1 | * | 1/2004 | Taft | 108/57.25 |
| 2004/0094073 | A1 | * | 5/2004 | Lacabanne | 108/57.19 |
| 2005/0081764 | A1 | | 4/2005 | Michaels et al. | |
| 2006/0096508 | A1 | * | 5/2006 | Herring | 108/54.1 |
| 2006/0169185 | A1 | * | 8/2006 | Williams, Jr. | 108/56.3 |
| 2008/0066657 | A1 | * | 3/2008 | Kuo | 108/57.19 |

FOREIGN PATENT DOCUMENTS

| | | | |
|---|---|---|---|
| DE | 295 07 582 | U1 | 7/1995 |
| EP | 2138412 | A1 | 12/2009 |
| JP | 2002019780 | A | 1/2002 |
| WO | 9420377 | A1 | 9/1994 |

OTHER PUBLICATIONS

The International Search Report from corresponding International Application No. PCT/EP2009/059094 dated Apr. 9, 2010 (12 pages).
European Search Report for Serial No. EP 09 16 3643 dated Sep. 25, 2009.

* cited by examiner

*Primary Examiner* — Janet M Wilkens
(74) *Attorney, Agent, or Firm* — McCormick, Paulding & Huber LLP

(57) ABSTRACT

A pallet comprises a plurality of side rails, each side rail including upper and lower runners; a multiplicity of boards, each board being adapted to extend between a runner of two of the rails; a spine member extending parallel to the rails, the spine member including upper and lower spine runners, each board including a spine engaging portion adapted for sliding engagement with a spine runner; and locking member adapted when locked to prevent sliding disengagement of the boards from the slide runner.

12 Claims, 24 Drawing Sheets

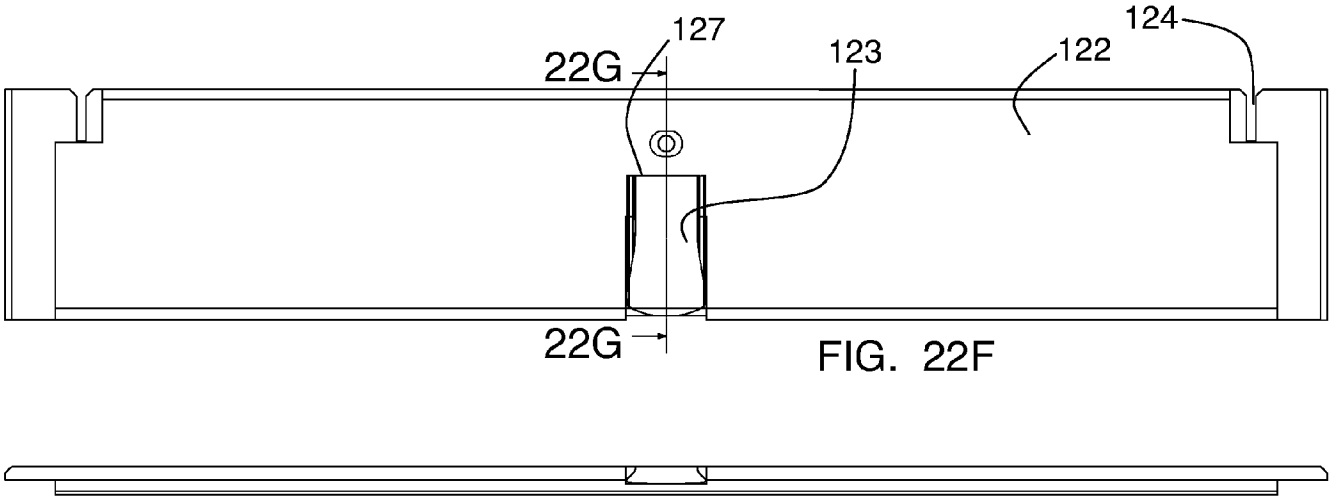
FIG. 22F
FIG. 22B
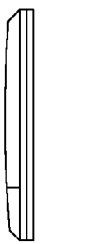
FIG. 22E
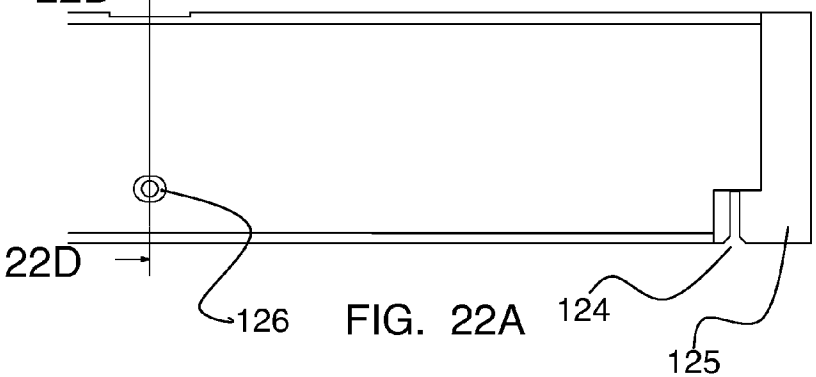
FIG. 22A
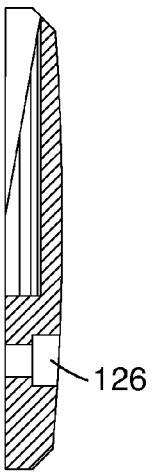
FIG. 22D
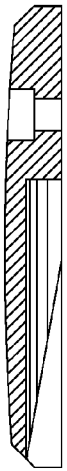
FIG. 22G
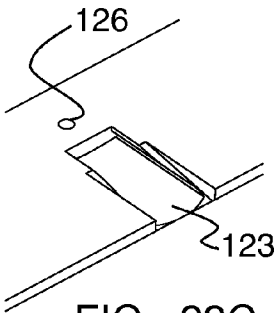
FIG. 22C 23G
23G 23F
23F 131
130
129

130
129
128
129

306
302
303
304
307

301
307
306
305
303
302
306
308
302
304
300

301
306
303
305
300

307
301
303
304
300

308
301
304
306
300

PALLET

CROSS REFERENCE TO RELATED APPLICATION

Applicant hereby claims foreign priority benefits under 35 U.S.C. §119 from Great Britain Patent Application No. 0811636.0 filed on Jun. 25, 2008, the contents of which are incorporated by reference herein.

FIELD OF THE INVENTION

This invention relates to a pallet and to a method of assembly of a pallet. Pallets in accordance with this invention are particularly, but not exclusively, of the kind used for transportation and storage of bulky objects, for example, transportation using fork-lift truck, trains, hoists or jacks. Pallets in accordance with this invention may also be used to provide support surfaces for displays, for example, signs or posters.

BACKGROUND OF THE INVENTION

Conventional pallets comprise ground or floor engaging bottom deck boards which may extend in a first direction, e.g. laterally, of the pallet; stringers or blocks mounted on the bottom deck boards and extending in a second direction, e.g. longitudinally of the pallet to join the deck boards; and top deck boards mounted on the stringers or blocks and adapted to carry a load in use. The top deck boards usually extend parallel to the bottom deck boards. Apertures between the top and bottom deck boards are adapted to receive the tines of a forklift or other lifting device or ropes which may be attached to a crane or hoist.

Conventional pallets are manufactured from timber joists and planks. Wooden pallets are difficult and uneconomical to repair and are usually destroyed if damaged in use. Such pallets are also bulky and difficult to transport. Nails used to fix the boards can be a safety hazard agent to the person handling the pallet or may damage the packaging of the goods being transported.

SUMMARY OF THE INVENTION

It is an object of the present invention to provide a demountable pallet which may be assembled from modular or replaceable components and which can be dismantled for transportation, storage or replacement of a damaged component without use of nails.

According to a first aspect of the present invention, a pallet comprises:

- a plurality of side rails, each side rail including upper and lower runners;
- a multiplicity of boards, each board being adapted to extend between a runner of two of the rails;
- one or more spine members extending parallel to the rails, each spine member including upper and lower spine runners;
- each board including a spine engaging portion adapted for sliding engagement with a spine runner; and
- locking means adapted when locked to prevent sliding disengagement of the boards from the spine runner;

each board having two ends, the ends being formed with an engagement portion;

each rail having a plurality of sockets, each socket being adapted to receive and engage an engagement portion of a respective board;

wherein the board is disengaged from the rail and may be moved parallel to the rail between an unlocked position wherein a board may be inserted into or removed from the socket and a locked position wherein board is engaged with the rail preventing removal from the socket.

The present invention provides a pallet which may be assembled by inserting the ends of each board with respective sockets and sliding each board in a direction parallel to the rails into engagement with the side rails. Then the spine member may be slidably engaged with the boards to form a rigid pallet capable of supporting a load in use. The pallet is further capable of being dismantled for transportation, storage or repair. Reduced volumes are required for transportation of the disassembled pallet components. Service inspection of the disassembled products and repair if necessary are facilitated. Different components of the pallet may be made from different materials in order to more efficiently meet their different structural and load bearing requirements. This allows flexibility of supply chain management and product life cycle management. One or more of the components, preferably the final locking member, may include an identification device, for example a radio frequency identification device (RFID) disc or label so that the pallet has a recorded identity from the production date. The physical location may be also recorded and tracked together with the servicing record, using GPRS logistics.

Locking or unlocking by movement of the boards parallel to the rails in a longitudinal direction with respect to the rails and spine member has the advantage that the components in the pallet cannot be disengaged by lateral movements, perpendicular to the rails during use. Furthermore prevention of sliding movement of the boards along the spine member by the locking means provides a simple and reliable procedure for assembly and for dismantling the pallet by placing the rails in position and subsequently adding and removing the remaining components. Use of both longitudinal and transverse movements during assembly is thereby avoided.

In a preferred embodiment wherein each board has a tongue at each end, the tongues extending transversely of the pallet towards the sockets in the respective rails; each tongue including a formation defining an abutment extending parallel to the rail and adapted to engage a complementary formation of the rail as the board slides from the unlocked to the locked position.

The formation preferably comprises a slot extending parallel to the rail and dimensioned to receive a rib integral with the rail and extending towards the socket. The rib is preferably a parallel sided part of the box section of the rail.

Alternatively the formation may comprise a rib or series of projections arranged to be received in a slot in the rail.

Each board may have a projecting tongue or rib adapted to be slidably received and engaged within the channel. Each side rail may include a plurality of inwardly extending projections and sockets located between adjacent projections, each socket being adapted to receive a board inserted between the rails and further adapted so that the board when received in the socket may be moved slidably in a direction parallel to the rail into the channels to engage the rails at each end of the board.

The board may have a longitudinal slot extending longitudinally of the pallet, parallel to the rail, and adapted to engage an edge of the respective runner. Such an arrangement conveniently locks the board and rails together, and is resistant to lateral or transverse movement of the rails and boards.

In preferred embodiments the slots or other formations of the boards extend in use parallel to the rails in a direction outwardly from the centre of the rail towards the front or rear ends of the rail. In these embodiments the boards may be inserted into sockets and slidably moved in outward directions into their locked positions.

Each tongue is preferably received by sliding movement within a channel of the rail. This serves to facilitate engagement of the board and rail and prevents twisting in use.

A pallet in accordance with this invention has an advantage that the rails and spine member may be formed from hollow box or tubular sections so that the rails and spine members have apertures which extend lengthwise of the pallet. Adjacent pallets may be fastened together end-to-end, using rope or chains to form an elongate structure. Such a structure may be used as a bridge in the event of flooding or to allow passage over muddy or unstable terrain. In preferred embodiments the pallets are composed of reinforced composite material, for example a wood reinforced polymeric composite. Such pallets are buoyant and may serve as safety floats or may be connected together to form a floating bridge or pontoon in the event of flooding or heavy rains.

A pallet in accordance with this invention has the further advantage that it may be assembled without use of nails, screws, clips or other fixings, avoiding the need to maintain and transport a supply of the necessary number of such fixings.

The pallet may be manufactured from extruded polymeric materials, e.g. polypropylene or other engineering thermoplastics, or from aluminium or other extrudable metals. Use of wood-plastics composite materials is especially preferred. Such materials can incorporate scrap timber and wood products. Use of recycled waste wood products is particularly preferred in order to minimise environmental damage.

In a preferred embodiment each spine runner includes a pair of longitudinally extending ribs, the ribs defining a channel between the ribs, the channel and ribs being adapted to engage and retain a complementary formation of the spine engagement portion of a board.

In an alternative embodiment the spine has a longitudinal axis and spine runners extending axially of the spine, and one or more said locking members being axially rotatable about the axis;

the locking members including spine runner portions; the locking members being moveable from an unlocked position wherein the spine runner portion is aligned with a spine runner to form a continuous runner, and a locked position wherein the locking member obstructs the spine runner so that a board may not be slidably disengaged from the runner.

Each rotatable locking member may comprise a single longitudinal rib, the rib being adapted to be aligned in the unlocked position with one of the pair of ribs of a spine runner. In a preferred embodiment, the locking member comprises two single ribs located in diametrically opposed relation on opposite sides of the member. Such an arrangement allows the locking member to be disengaged from the board by a single rotational movement but yet allows insertion or removal of the board from engagement with the spine.

Preferably, the spine and locking members have an axial bore, a shaft being received in the bore to support the locking members during rotation in relation to the spine. In a first preferred embodiment, the shaft may be removed from the spine when not in use. In an alternative embodiment, the shaft may be permanently located within the bore to strengthen the spine and rotatable locking members.

A transverse aperture, lug, socket or other engagement structure may be provided on the locking members to receive a bar or tool to facilitate rotation of the member in use. For example, an aperture may be adapted to receive the blade of a screwdriver.

In a preferred first embodiment, the side rails have abutments at the ends thereof. These serve to prevent boards from sliding off the ends of the rails in use.

In a preferred embodiment, two locking members are provided between two spine members. The locking members may be located centrally of the spine members and centrally of the pallet to define a recess or socket into which boards may be inserted when the locking members are in the unlocked position. Following insertion the boards may be caused to slide longitudinally onto the spine and into engagement with the side rails.

In preferred embodiments, the side rail may comprise a box section extrusion with upper and lower runners facing inwardly of the pallet, each runner comprising an array of sections wherein a channel extends along each section with a rebate between adjacent channels, the rebate having a dimension to form a socket to receive and engage an end of a respective board.

According to a preferred embodiment of this invention, the boards are adapted to slidably engage the spine runner from a first end thereof, the locking means being adapted to secure at least one board slidably engaged on the first end of the spine.

Preferably the locking means comprises a bolt which may be received in apertures in the last board and in the spine. A bolt may be secured by means of one or more nuts. This provides a simple and sturdy means of locking the pallet assembly. Alternatively a screw or spring clip arrangement may be used. In addition the locking means may include a Radio Frequency Identification Device (RFID) or label to enable identification and tracking of the pallet The spine member may comprise two or more sections adapted to be located end to end along the axis of the pallet.

The boards may be separated by spacer sections with relatively narrow width, each spacer section being located between a pair of adjacent boards to provide a slatted upper and/or lower deck configuration.

BRIEF DESCRIPTION OF THE DRAWINGS

The invention is further described by means of example, but not in any limitative sense, with reference to the accompanying drawings, of which:

FIGS. 21A to 23G illustrate the board members of the pallet;

In the following drawings the same reference numerals are used to denote the like components in each Figure.

DETAILED DESCRIPTION OF THE PREFERRED EMBODIMENTS

Figure 1:
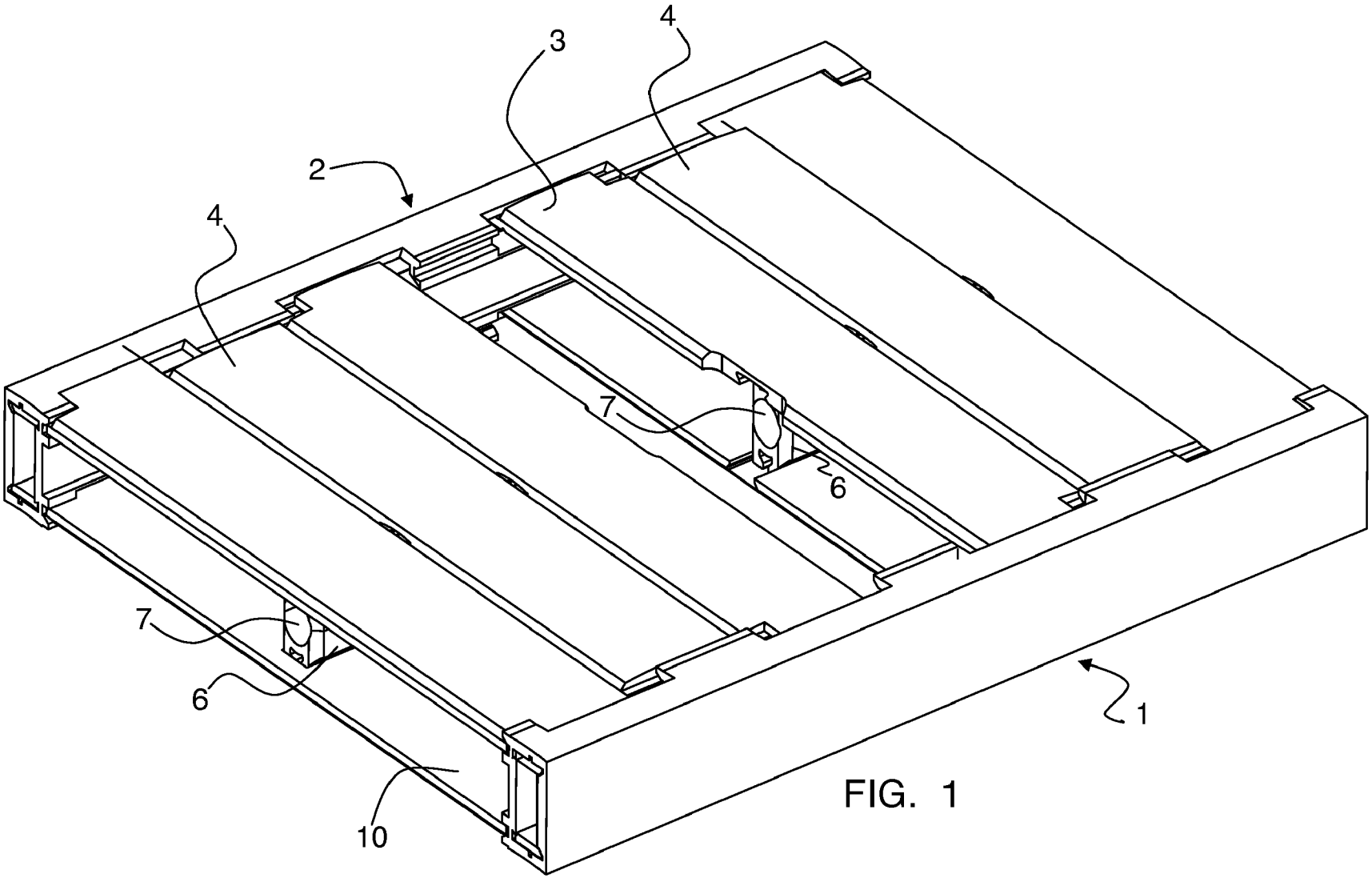
FIG. 1 is a perspective view of a pallet in accordance with the invention.
Figures 2A, 2B, 2C, 2D, 2E, 2F:
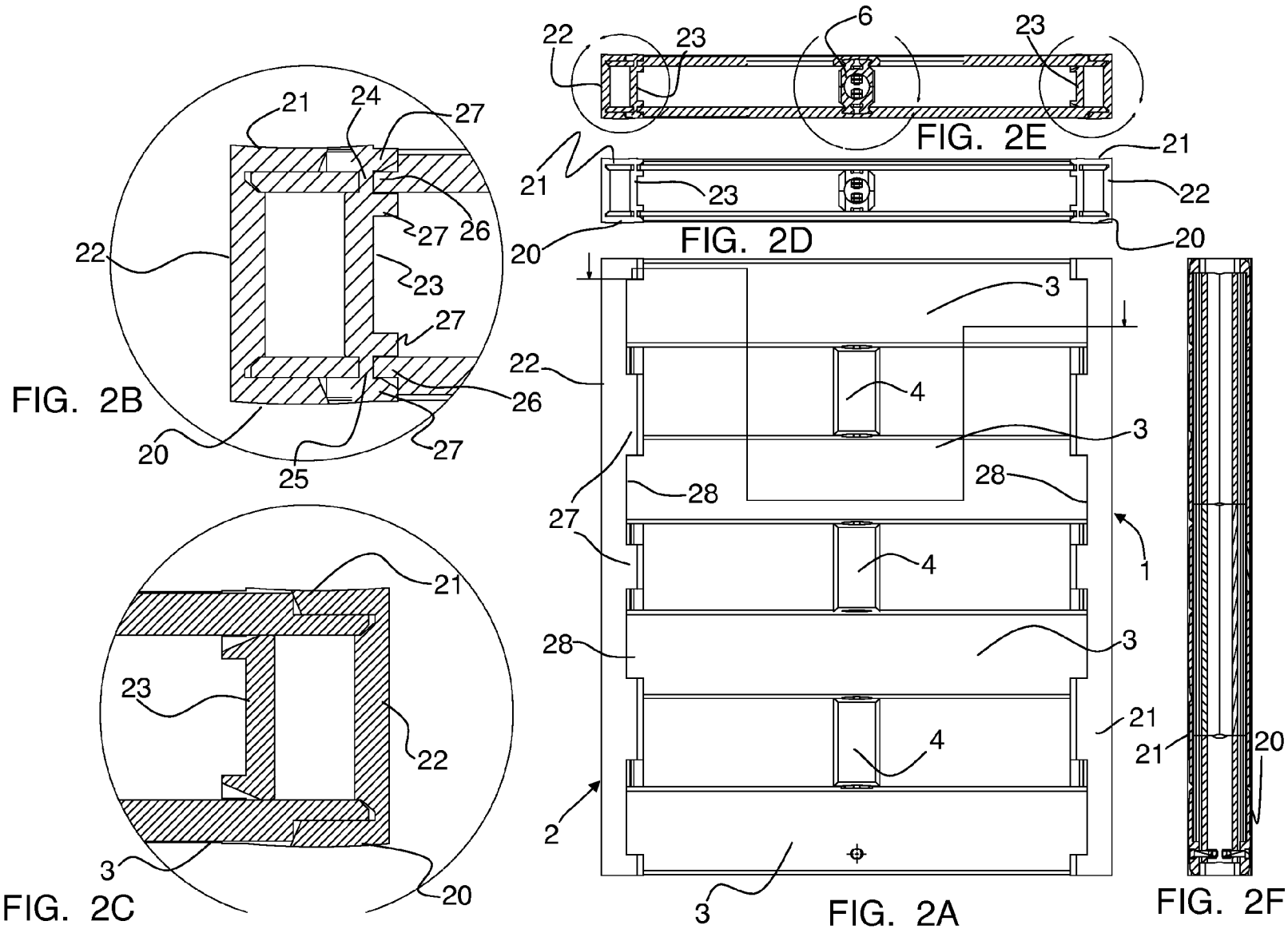
FIGS. 2A-2F are plan view elevation cross sections of a further pallet.

The pallet shown in FIG. 1 comprises a pair of longitudinally extending side rails or stringers (1,2) with an array of top deck boards extending between the side rails. The top deck boards comprise first (3) and second (4) boards arranged alternately.

Two spine members (6) extend axially longitudinally of the pallet as described below. The spine members (6) have axial bores (7) providing a continuous channel from the front to the back of the pallet.

An array of lower deck boards (10) similar to the upper deck boards is adapted to engage the ground or floor surface in use.

FIGS. 2A-2F comprise a plan view, side and end elevations, cross section on R-R and detailed views of the cross section.

Each side rail (1,2) has a generally box-shaped extruded construction comprising a ground engaging lower portion (20), upper load supporting portion (21), an outer skin (22) and inner skin (23). The inner surface includes upper (24) and lower (25) runners extending longitudinally of the pallet. The runners face inwardly of the pallet in use. Each runner comprises a channel (26) adapted to receive and engage a correspondingly shaped projecting tongue or rib of a board when the pallet is assembled.

The channels (26) are each defined by parallel projections (27) extending inwardly from the lower or upper surfaces (20) of the side rail. Rectangular or otherwise shaped rebates or sockets (28) are located between each projection (27). The rebate or sockets (28) are dimensioned to receive the end of a board during assembly of the pallet.

Figure 3B:
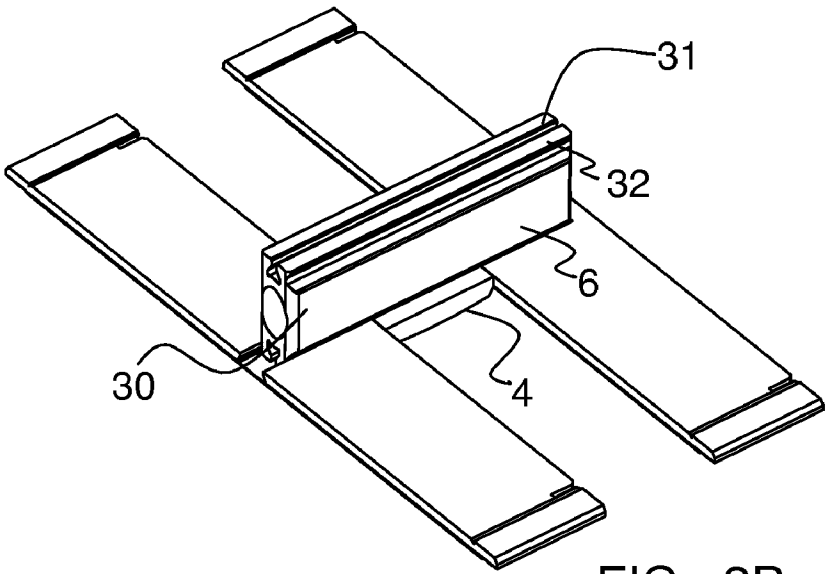
FIGS. 3A to 8 are perspective views showing assembly of a pallet as shown in FIG. 1.
Figure 3A:
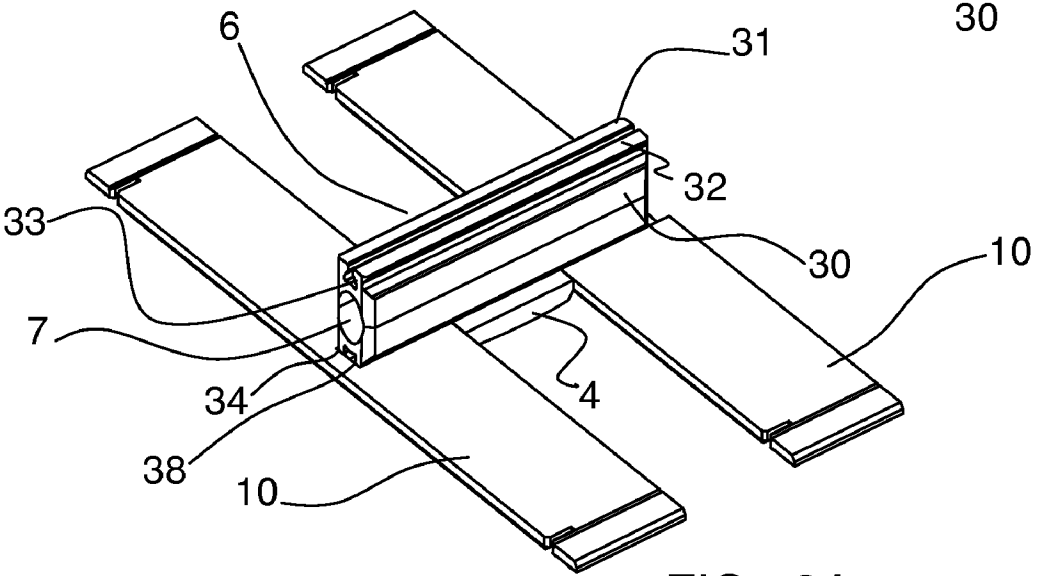
Figure 20:
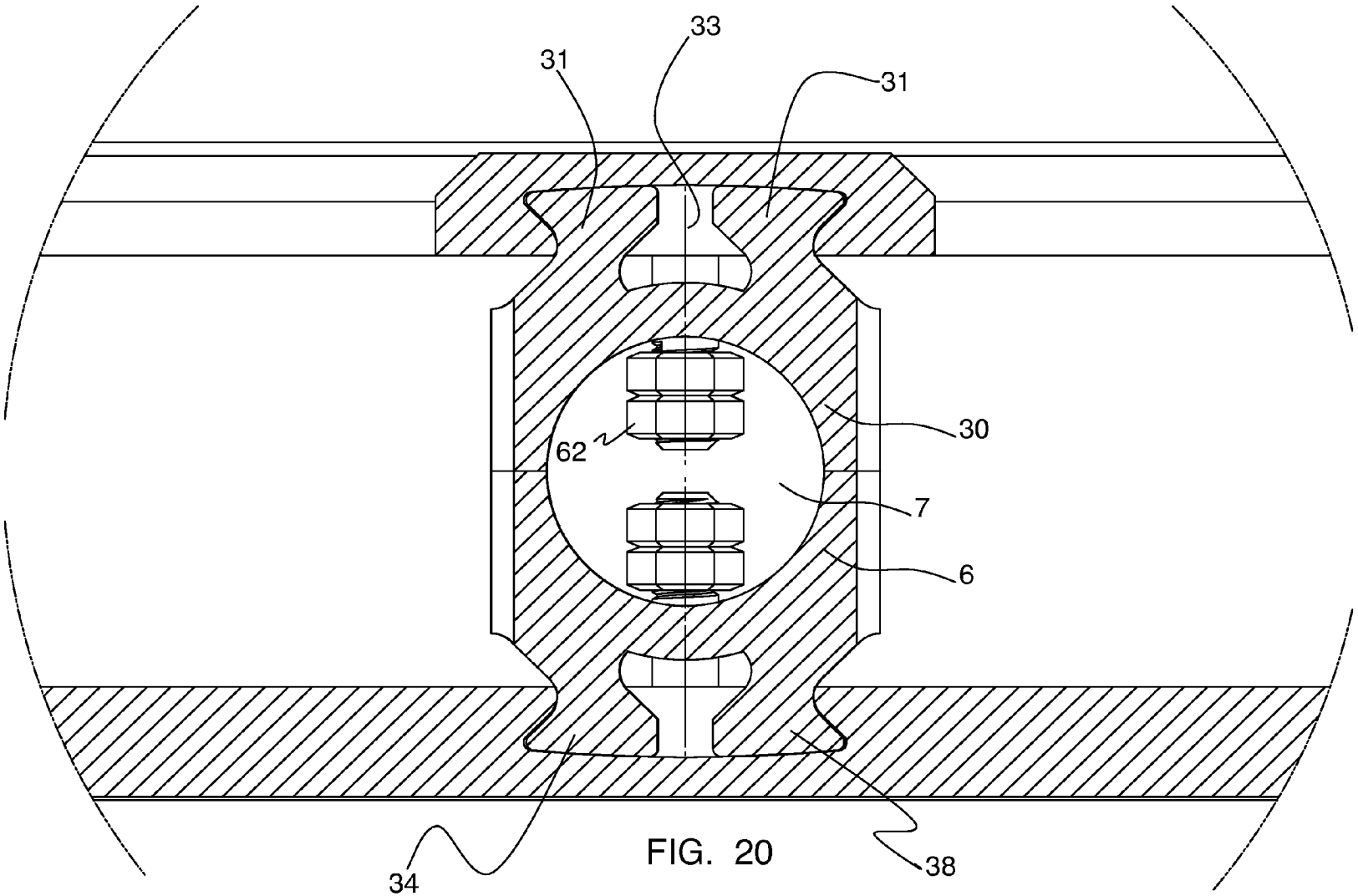
FIG. 20 is a cross sectional view illustrating the locking arrangement and engagement of the spine and board members.

FIGS. 3A and 3B show a perspective view of two spine members (6) with lower boards (10) attached. A pair of central spine members (30) carry a pair of upwardly extending parallel ribs (31,32) defining a channel (33) between the ribs (31,32). A corresponding pair of lower ribs (34,38) is provided on the lower surface of the spine. The channel (33) has a narrow mouth and wider interior as shown in FIG. 20, so that a correspondingly shaped projection extending from a board may be inserted into the channel by sliding longitudinally. The board is held securely and supported against any twisting movement. Alternatively, the outer lateral surfaces of the ribs may be wider at the ends remote from the spine to engage the board in use.

During assembly of the pallet the boards (10) and spacer (4) are slid into engagement onto the lower ribs (34,38) of the spine to form two sub assemblies.

Figure 4B:
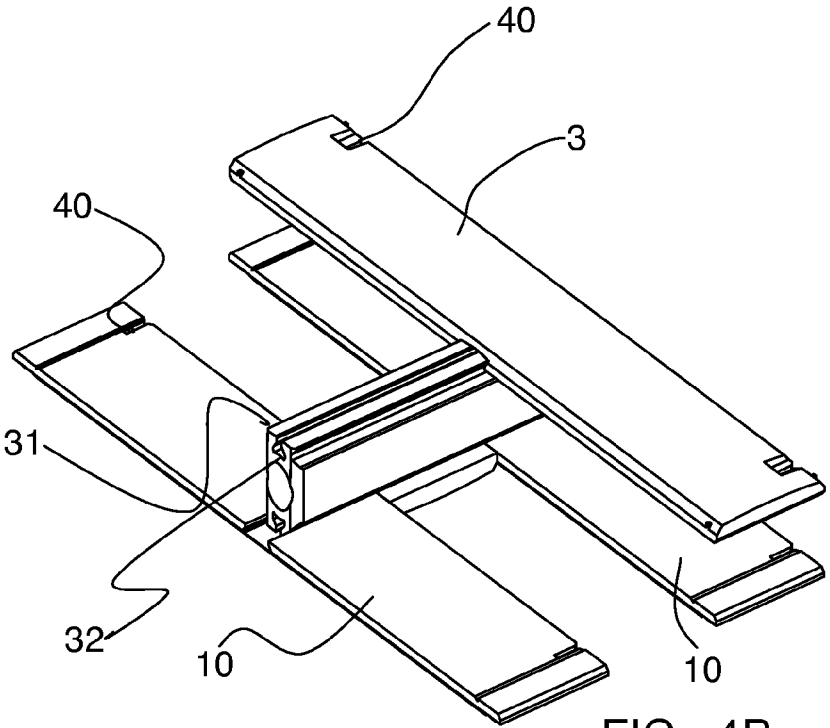
Figure 4A:
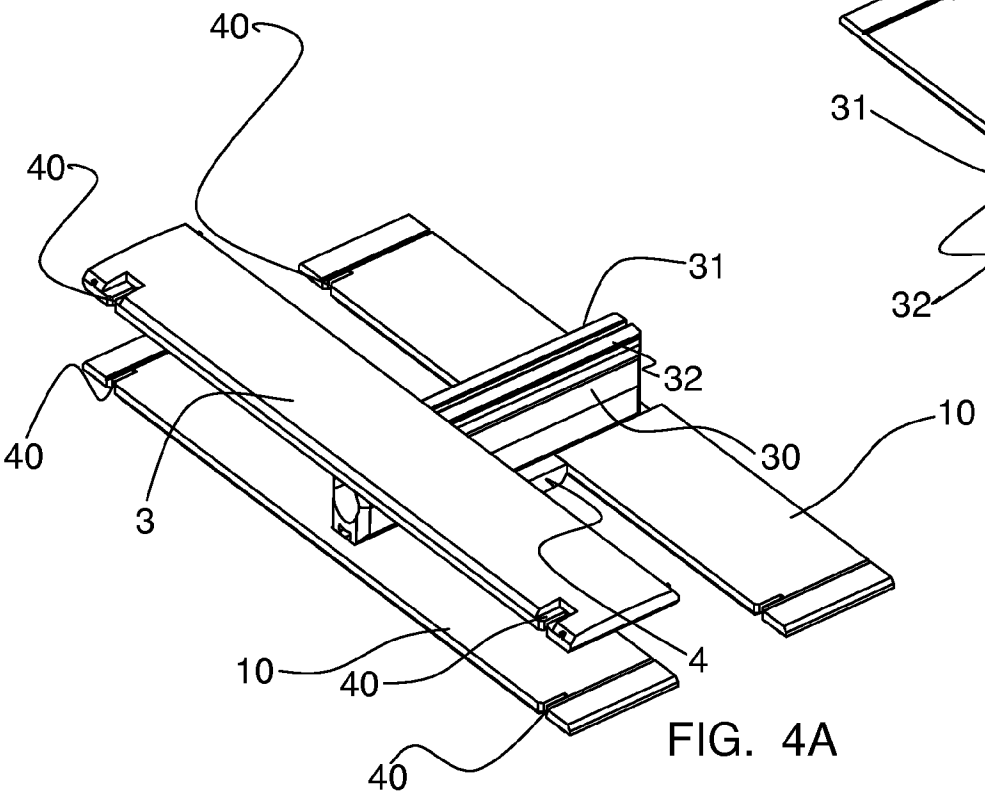

FIGS. 4A and 4B show the next stage of assembly in which upper boards (3) are slidably inserted onto the upper ribs (31, 32) of the spine. Slots (40) are arranged to extend parallel to the spine outwardly from the centre towards the front or rear of the pallet as shown in FIGS. 4A and 4B.

Figure 5B:
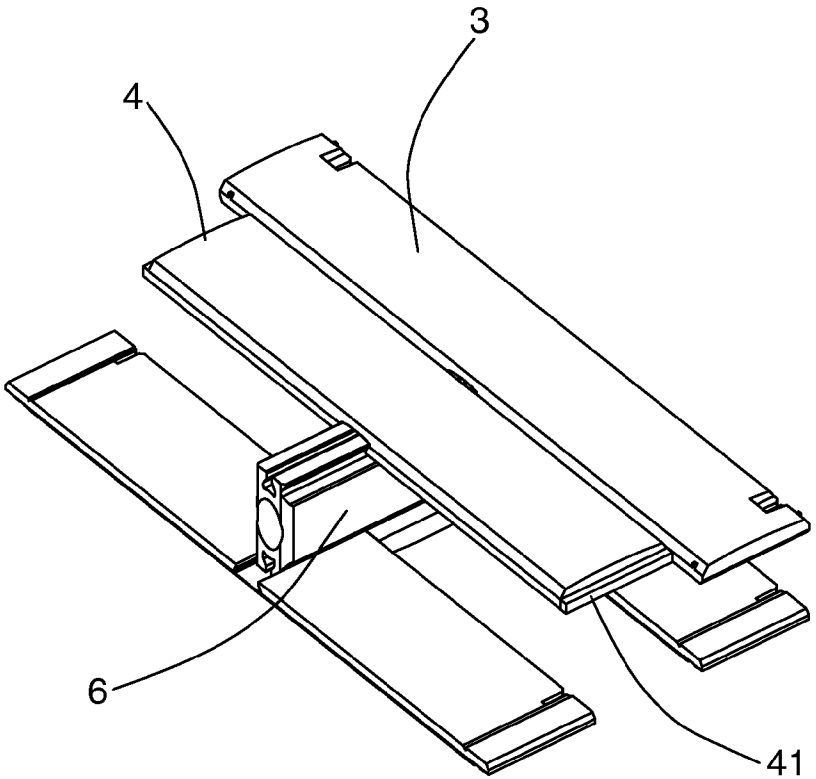
Figure 5A:
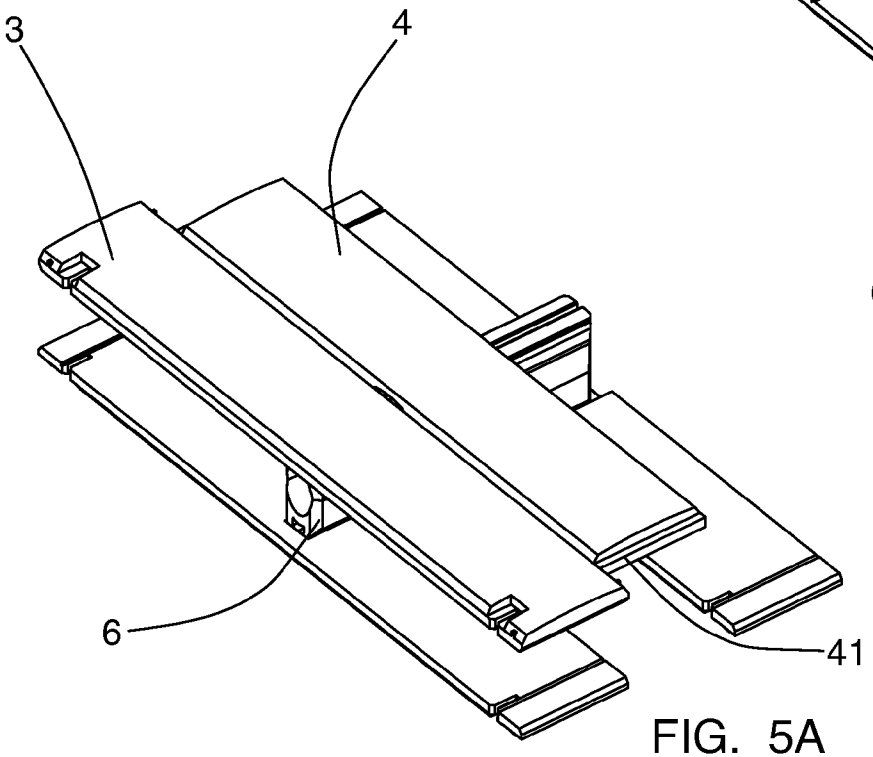

FIGS. 5A and 5B show the next stage of assembly in which spacer boards (4) are inserted adjacent the upper boards (3). The upper boards (3) have outwardly extending tongues (41) for engagement within channels of the rails.

Figure 6B:
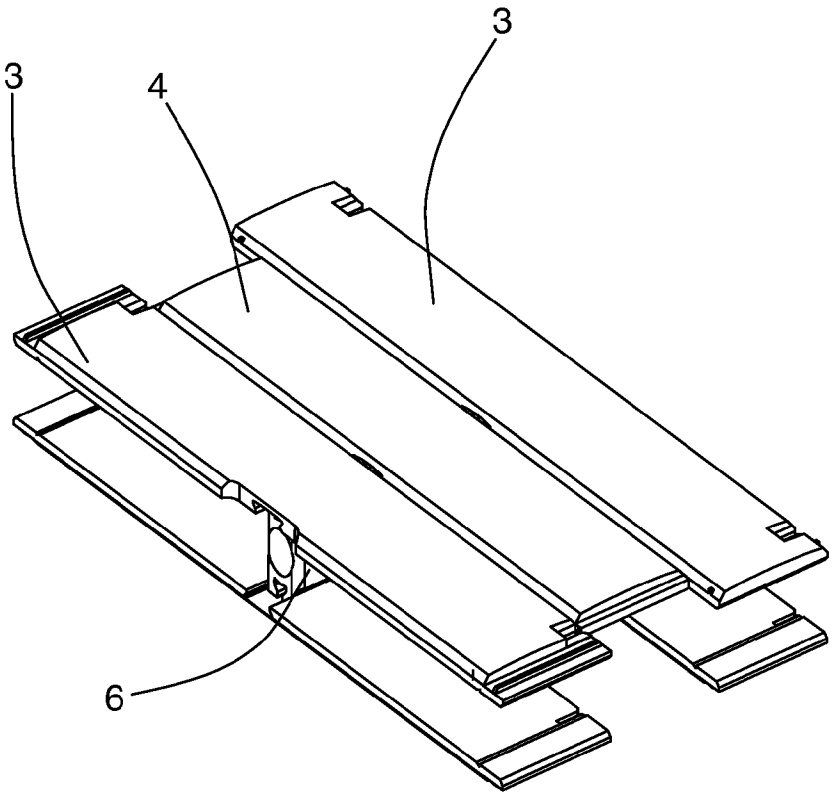
Figure 6A:
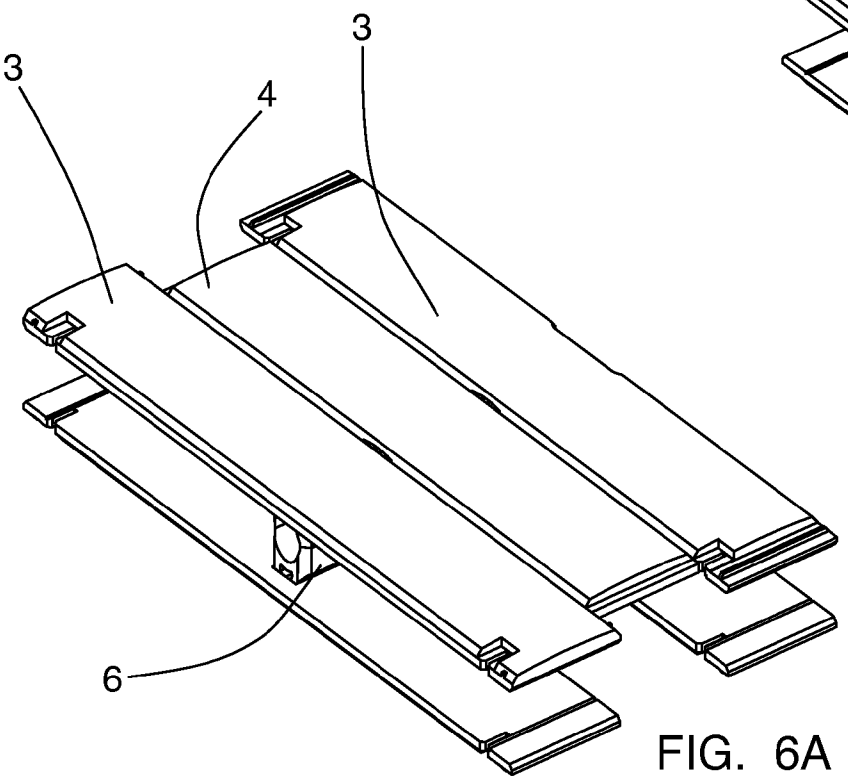

In FIGS. 6A and 6B further boards (3) are inserted onto spines to complete the sub assemblies of the pallet.

Figure 7:
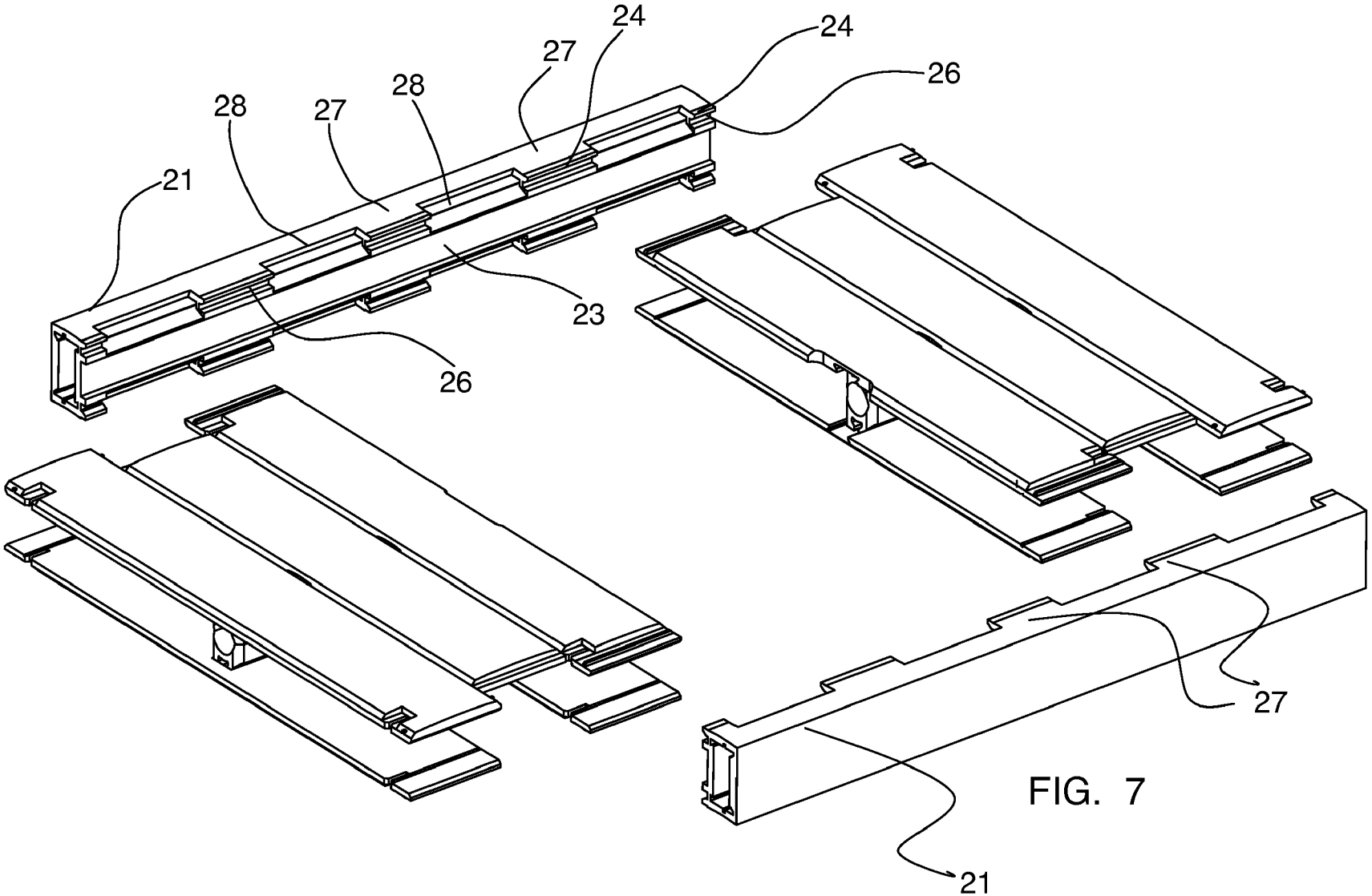
Figure 8:
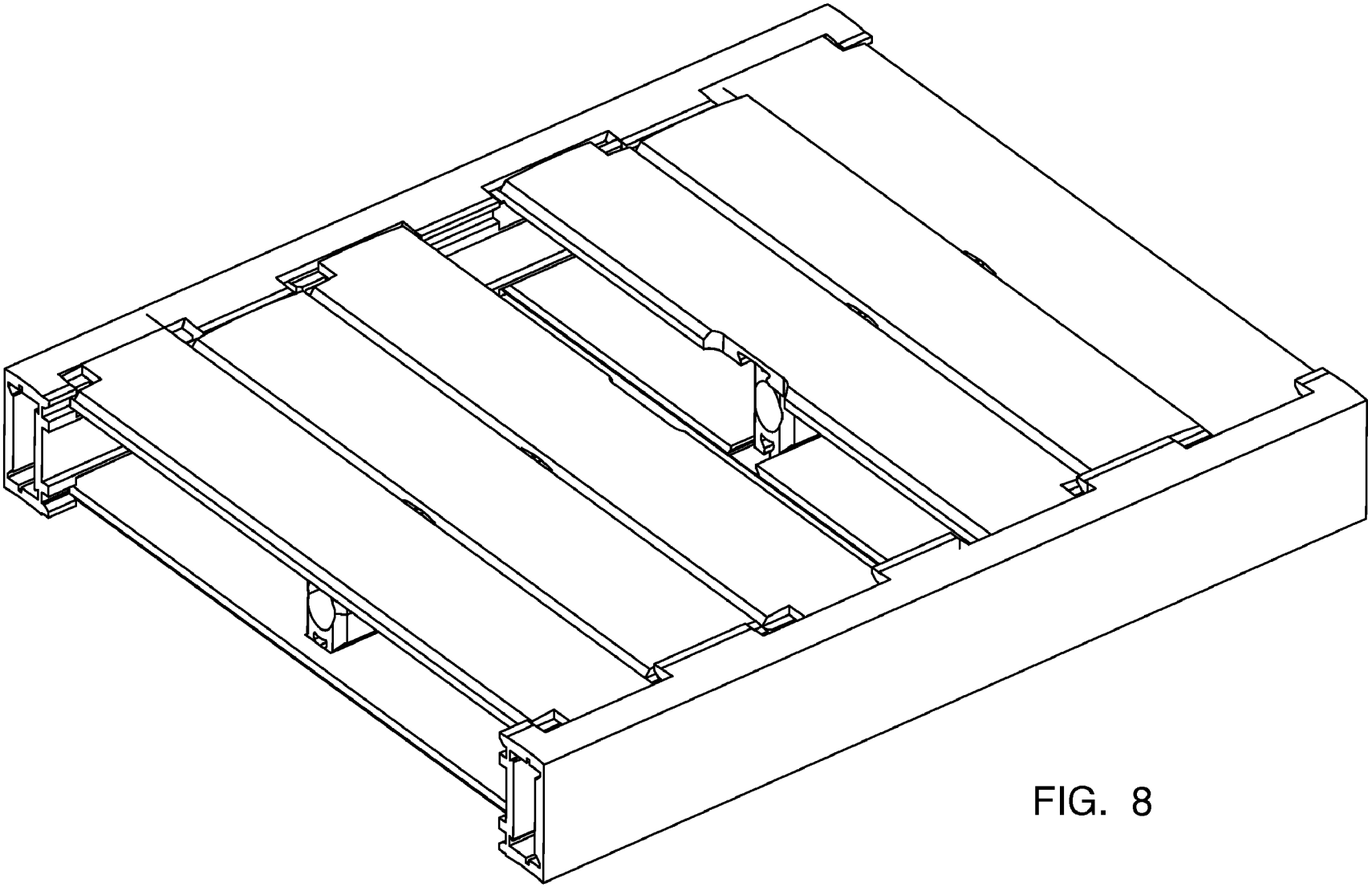

In FIG. 7 the side rails are inserted onto the ends of the sub assemblies so that the tongues of the boards are received in the sockets (28). The sub assemblies are securely engaged by sliding them outwardly towards the ends of the rails to produce an assembled structure as shown in FIG. 8. The upper and lower boards are locked into engagement with the rails to form a rigid structure. Continuous passageways extend lengthwise of the pallet through the rails and spine members so that ropes, cords or chains may be used to bind two or more pallets together in the event of flooding or other natural disaster.

The structure and assembly of further embodiments of the invention are described with reference to FIGS. 9 to 20.

Figure 9:
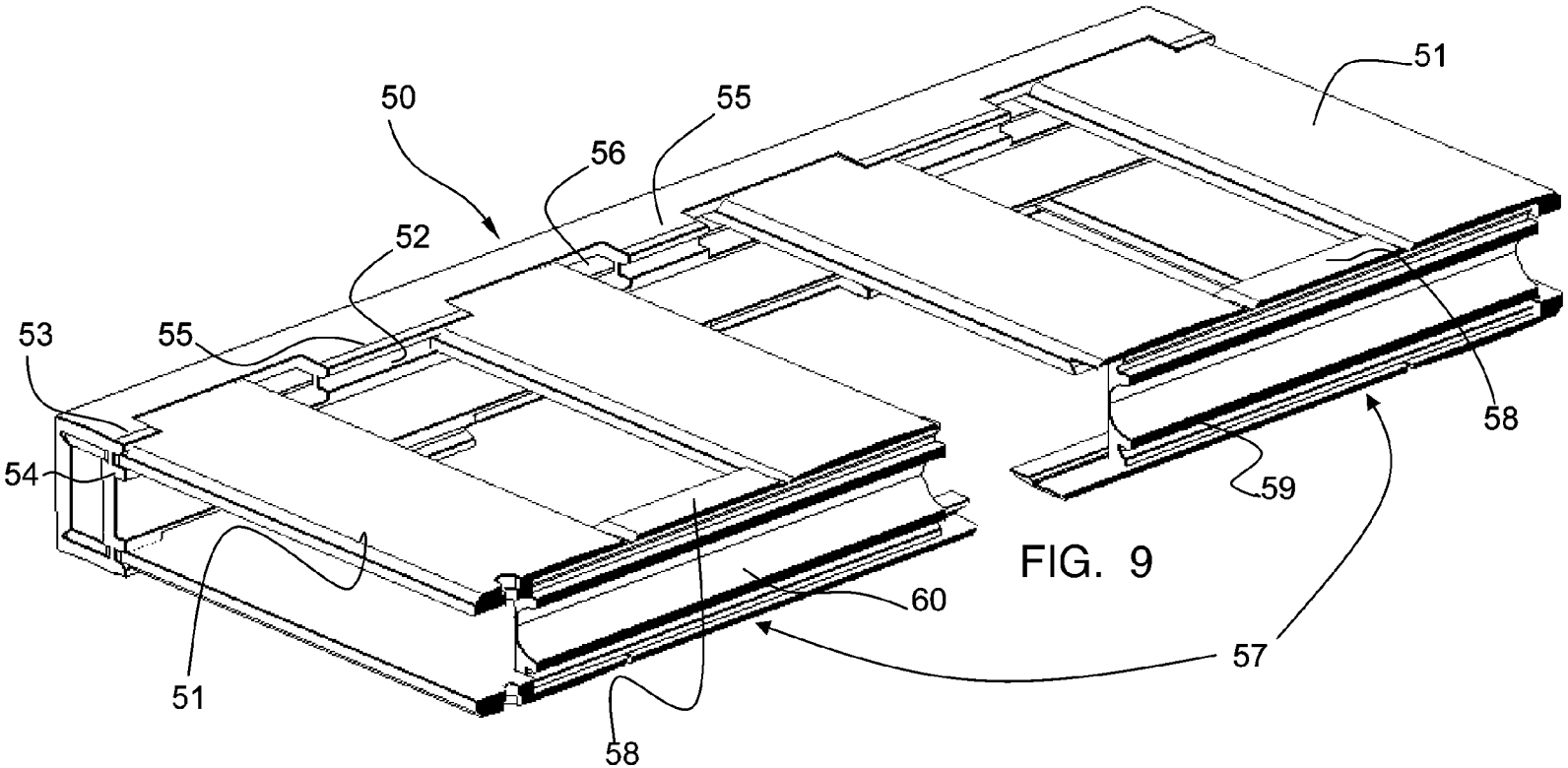
FIG. 9 is a cut away perspective view of a second embodiment of the invention.
Figure 10:
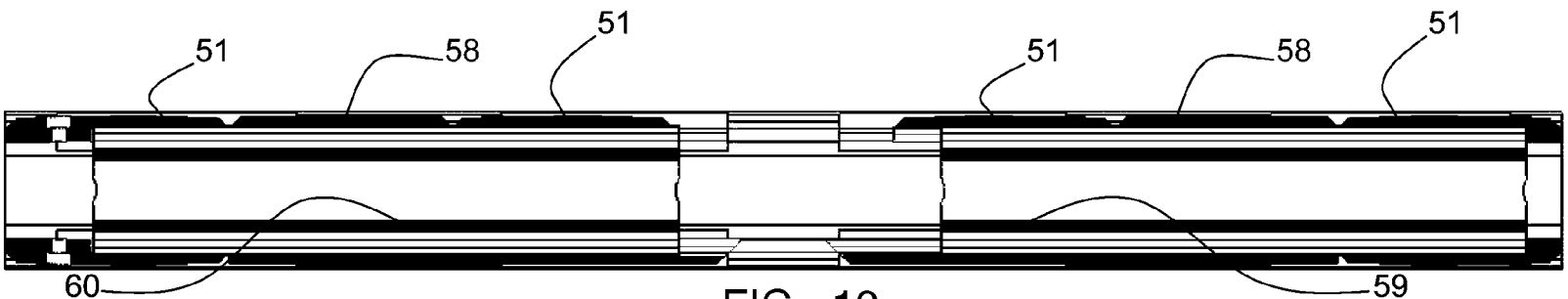
FIG. 10 is a view along the cross section of the embodiment shown in FIG. 9.
Figure 11:
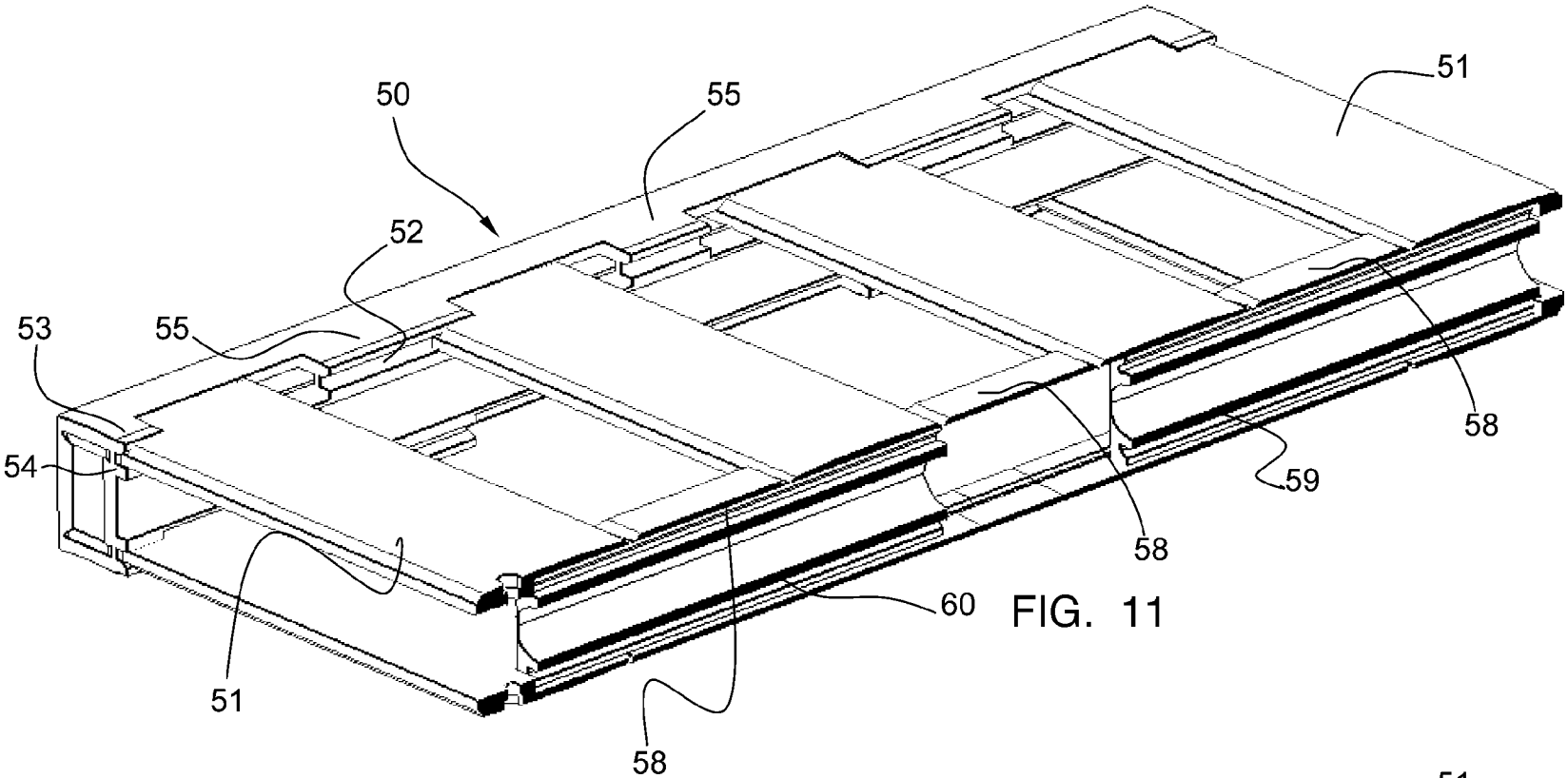
FIGS. 11 to 18 show further cross sectional and elevation views corresponding to FIGS. 9 and 10.
Figure 12:
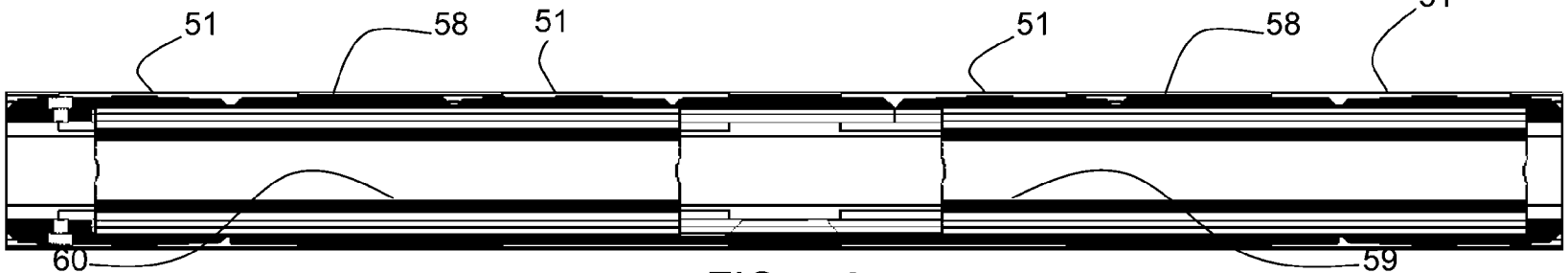
Figure 13:
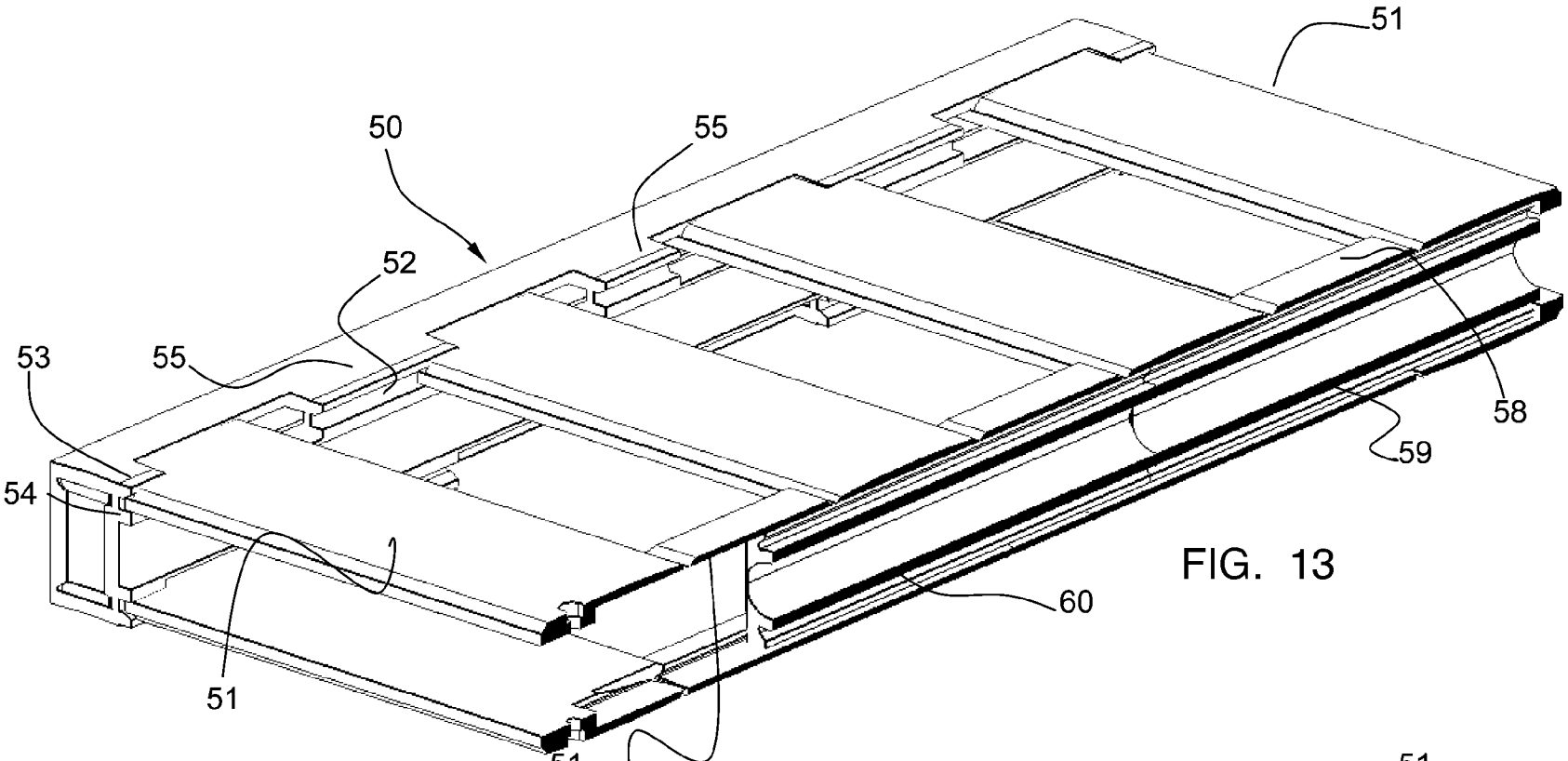
Figure 14:
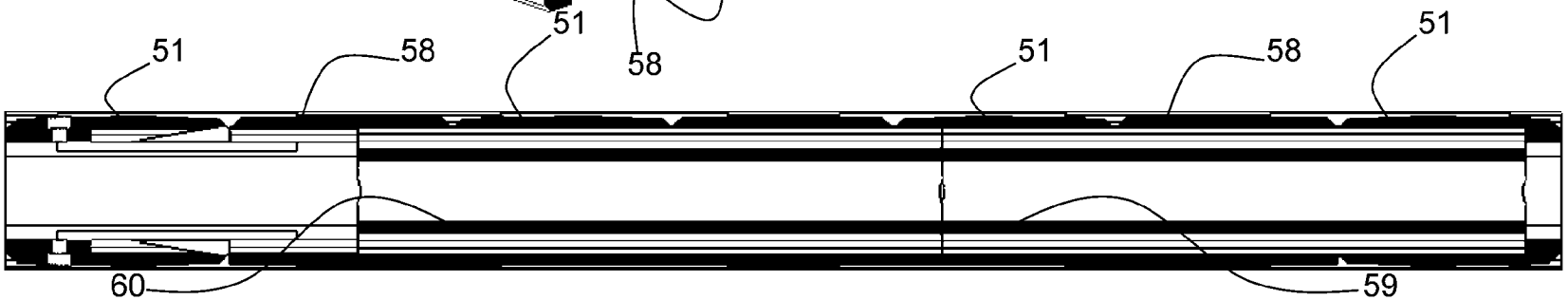
Figure 15:
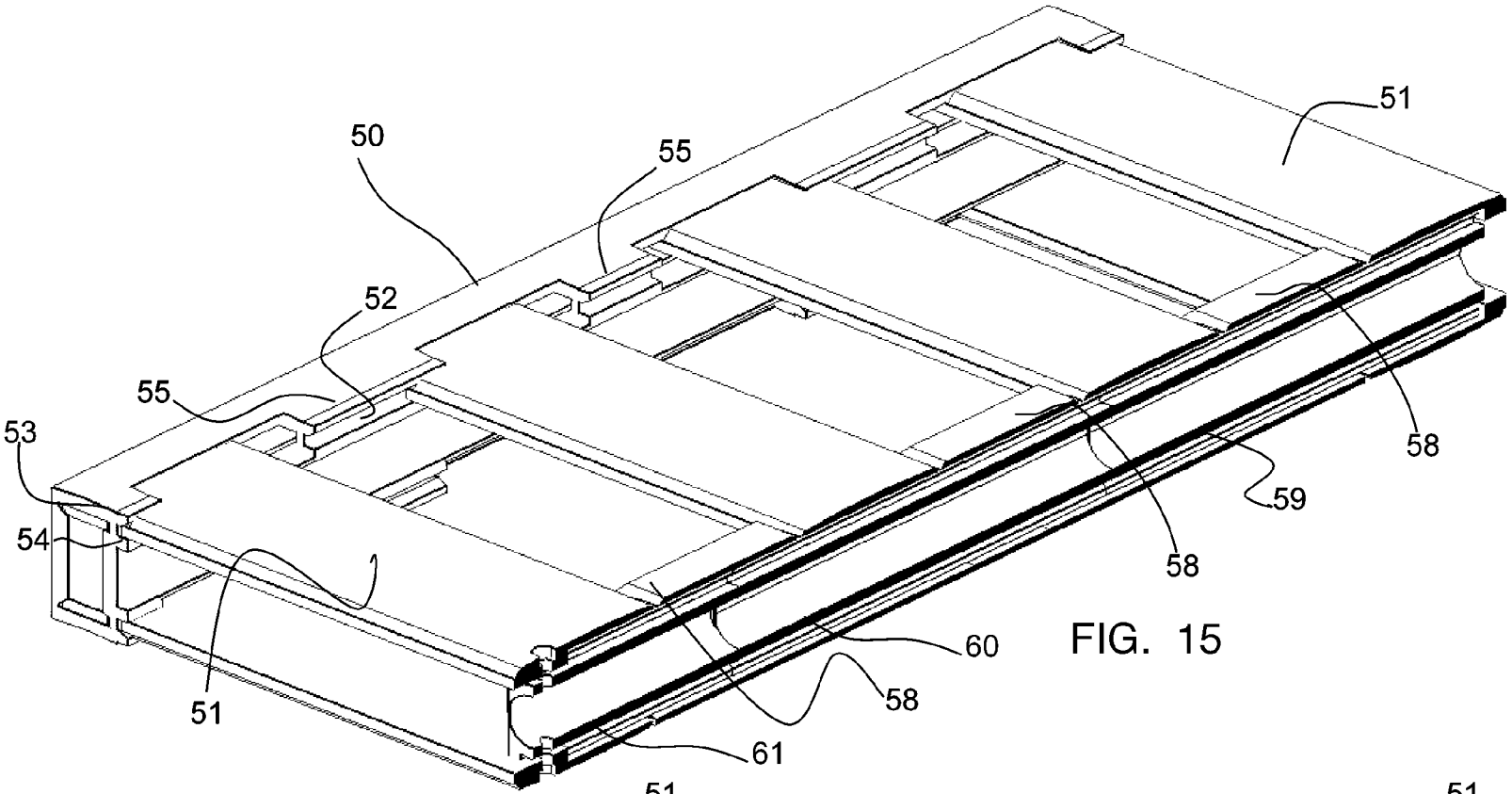
Figure 16:
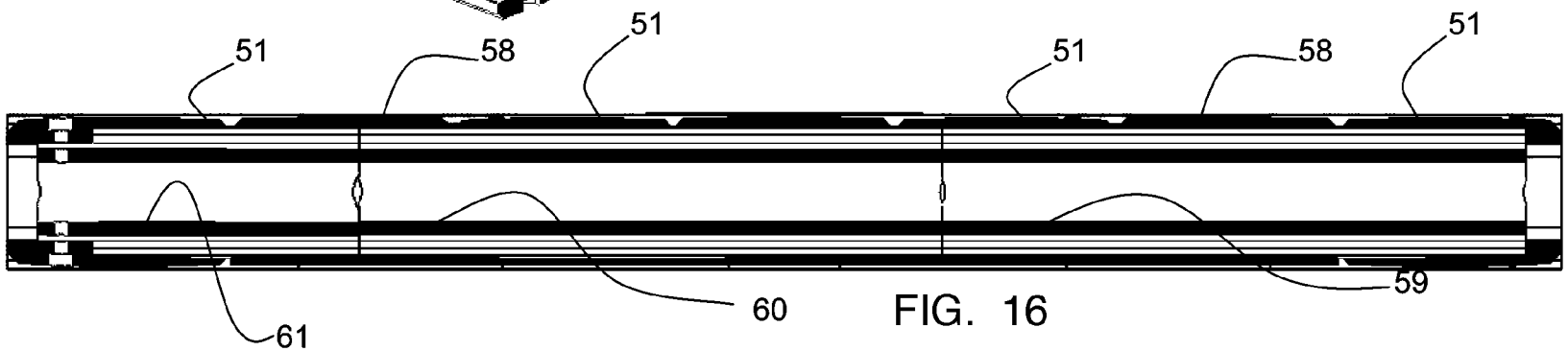

In the embodiment shown in FIGS. 9 and 10 the side rails (50) have a generally box shape construction. The inner surface of each side rail has upper and lower runners extending longitudinally of the pallet. Each runner includes a channel formed by parallel projections (53,54) adapted to receive a correspondingly shaped tongue or other projection of the boards (51) when the pallet is assembled. The channels (52) are each defined by projections (55) extending inwardly from the upper and lower surfaces of the side rail. Rectangular rebates (56) are located between each projection (55). The rebates or sockets (56) are dimensioned to receive a board (51) during assembly of the pallet. During assembly the boards (51) are located in the spacers and are then inserted by sliding into engagement with the spine (57). A spacer (58) is inserted into sliding engagement with the spine between each board (51). In this way a slatted construction is provided.

Figure 17:
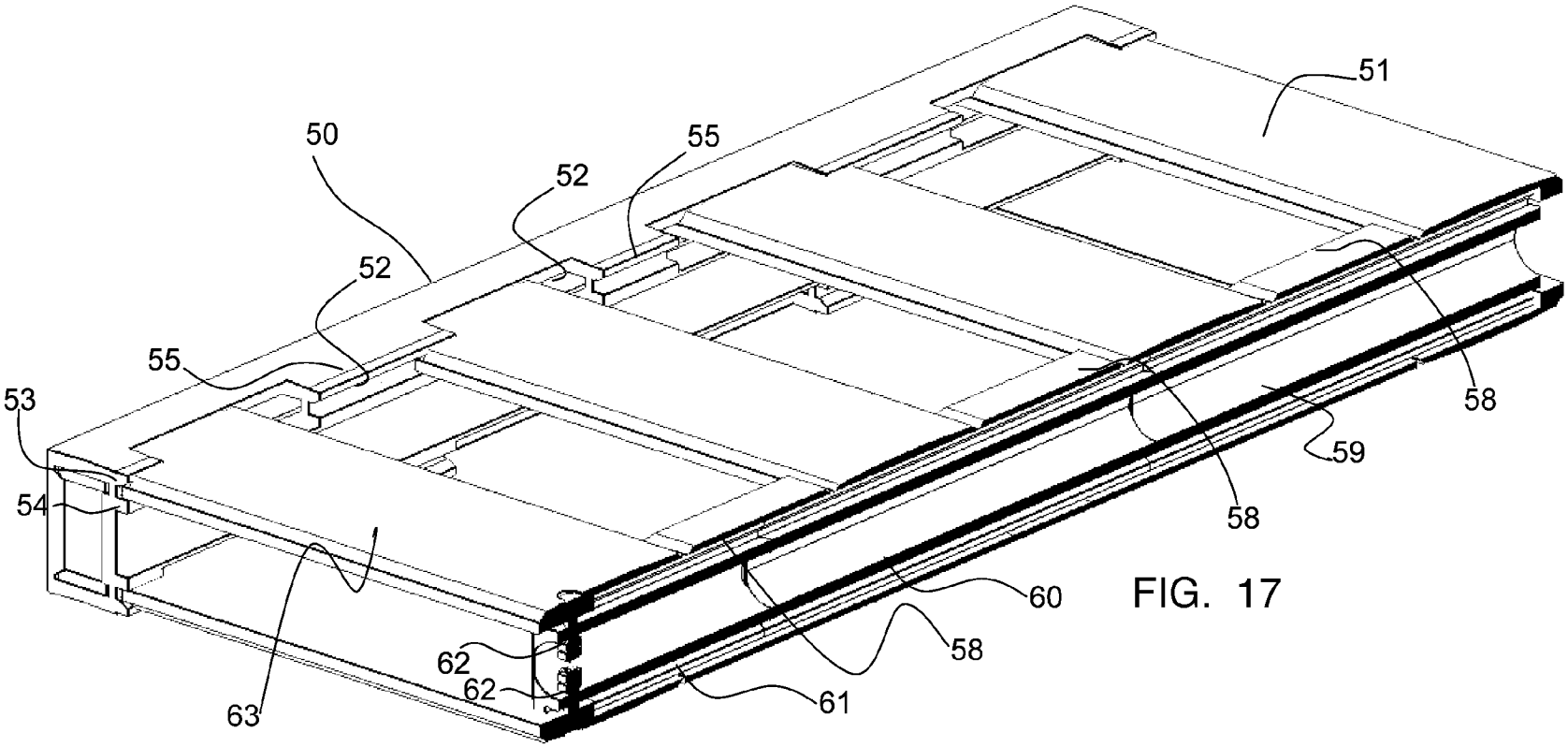
Figure 18:
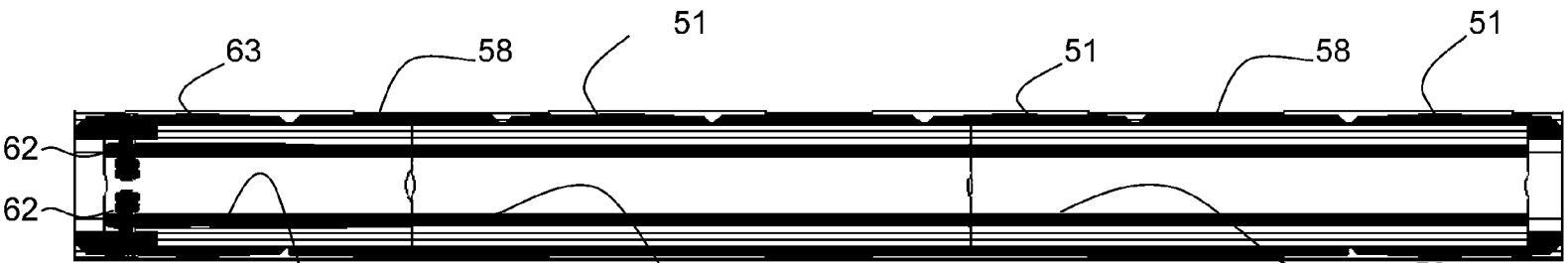
Figure 19:
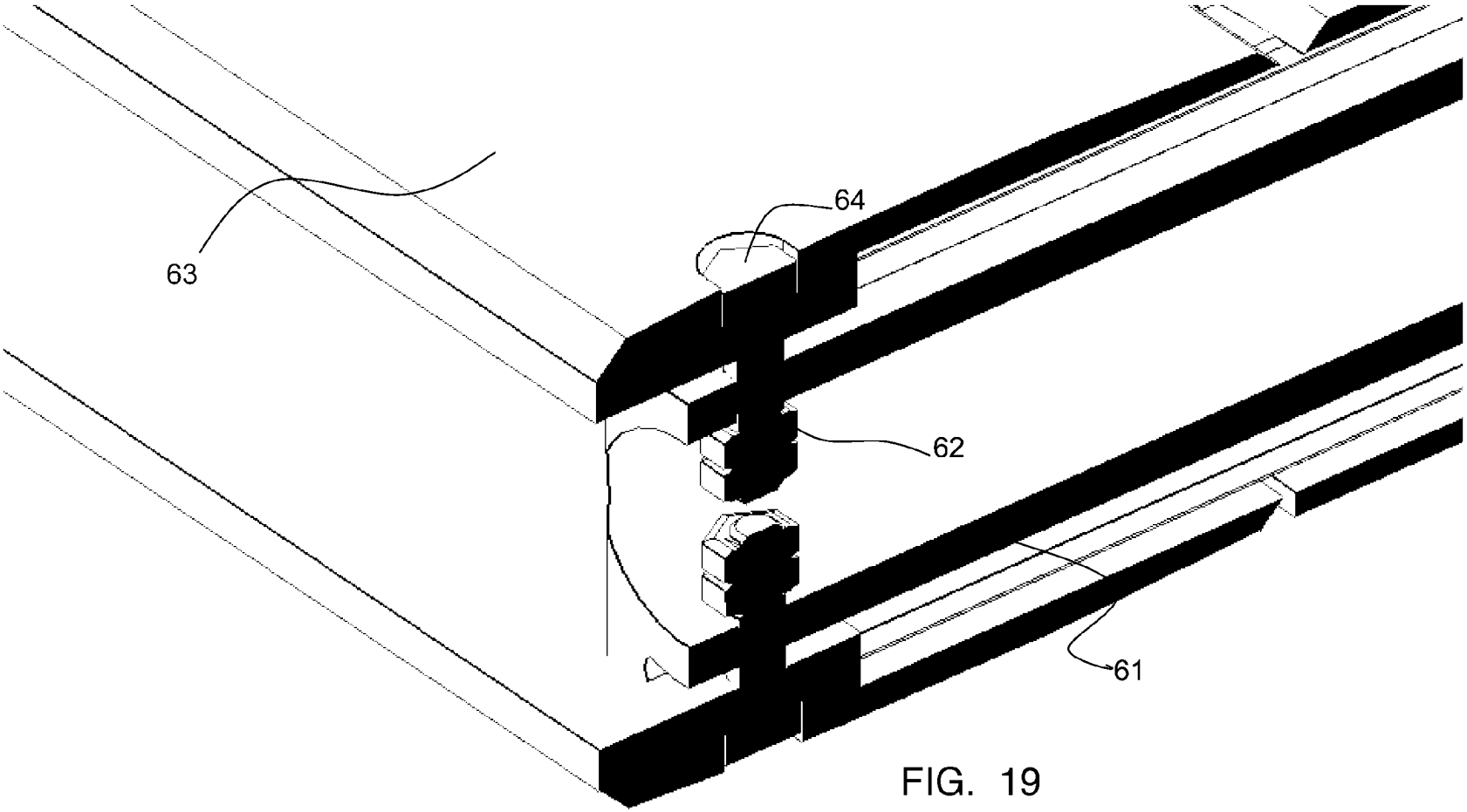
FIG. 19 is a detailed view showing the locking arrangement.

The spine (57) comprises two portions (59, 60) which collectively have a length shorter than the length of the pallet. During assembly of the pallet each spine portion may be assembled with upper and lower pairs of two boards (51) to form a H-shaped sub-unit as shown in FIGS. 3 to 6. This sub-units may be inserted into the side rails (50) following which the sub units are slid outwardly to engage the boards (51) into the sockets in the side rails as shown in FIGS. 17 and 18. This leaves a central aperture between the two spine members. In order to complete the assembly, one of the spine members (60) is pushed along the channel formed by the boards so that it contacts the second spine member to form a continuous spine. A locking spine member (61) comprising a short spine portion with a fixing means such as a socket for a bolt at one end, is then inserted into the channel end socket previously occupied by the first spine member to complete the spine unit. Finally one or more bolts (62) is located in the aperture (64) to secure the last board (63) to the spine member (61) as shown in FIG. 18.

FIG. 20 is an enlarged view of the embodiment shown in FIG. 2. This shows the spine 6 having upper and lower pairs of parallel ribs (31,34) received in sockets in the upper and lower boards (4,10) and secured by bolts (62).

Figure 21B:
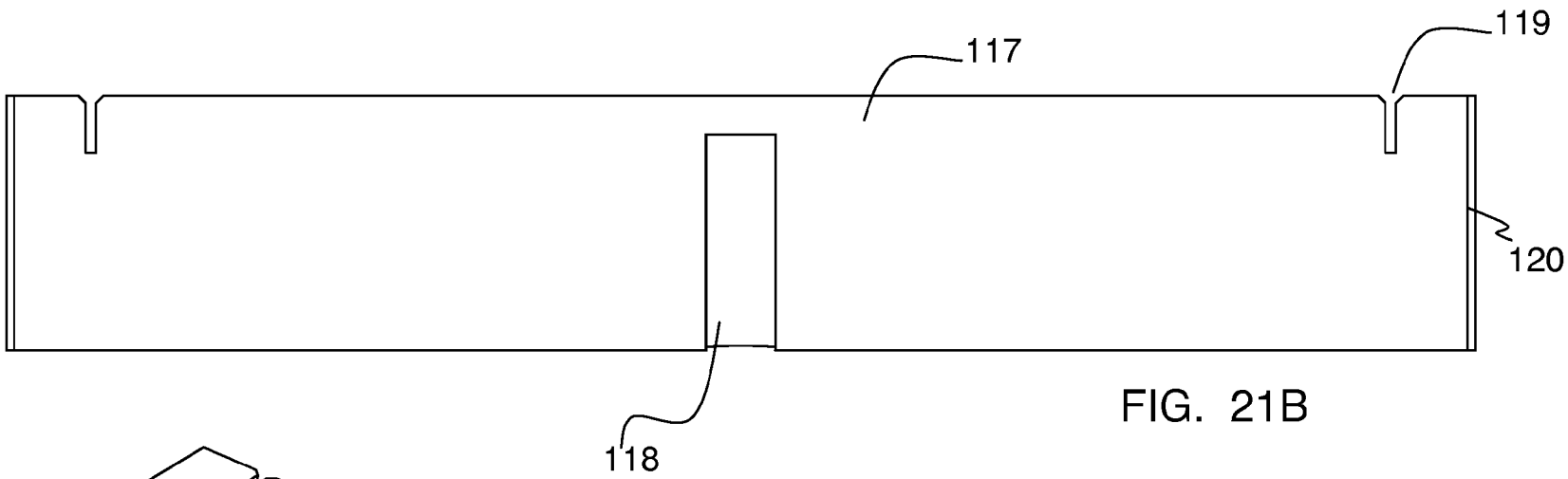
Figure 21A:
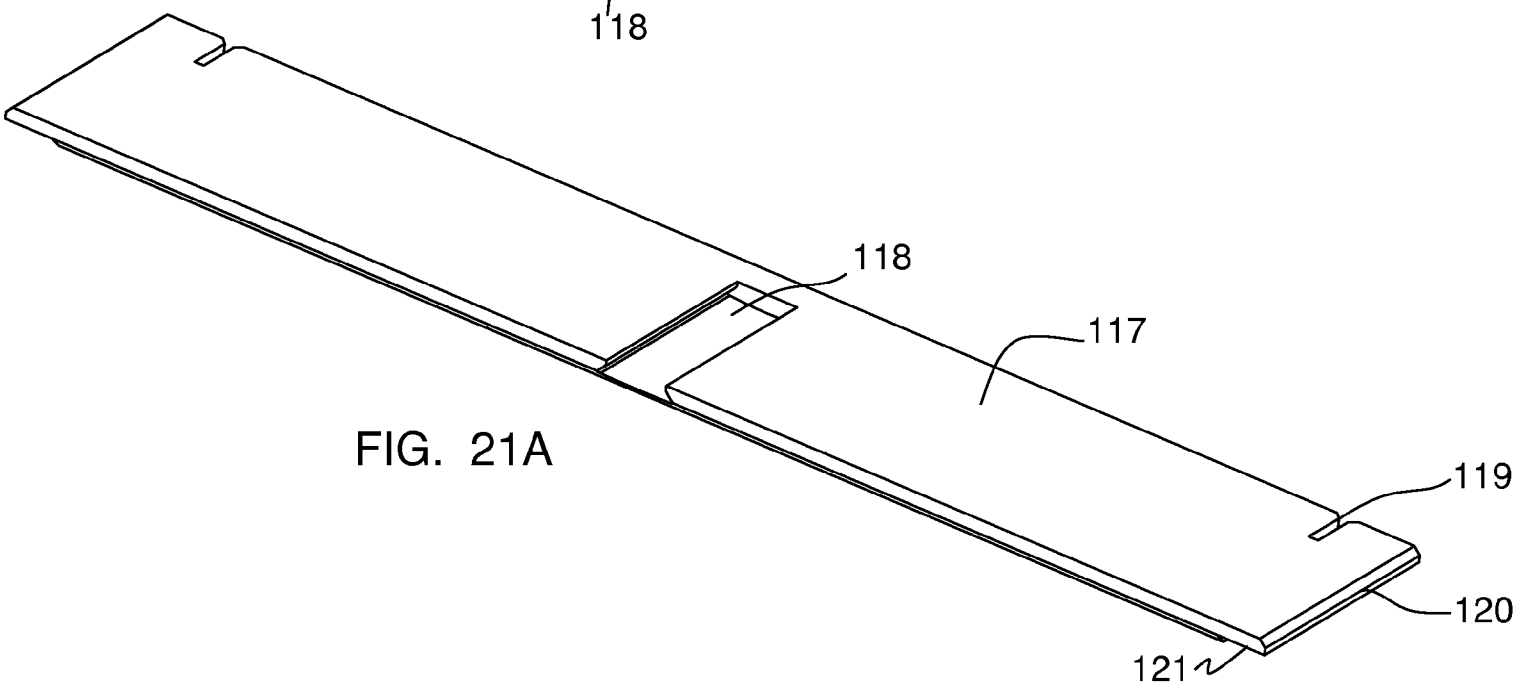
Figures 23A, 23B, 23C, 23D, 23E, 23F, 23G:
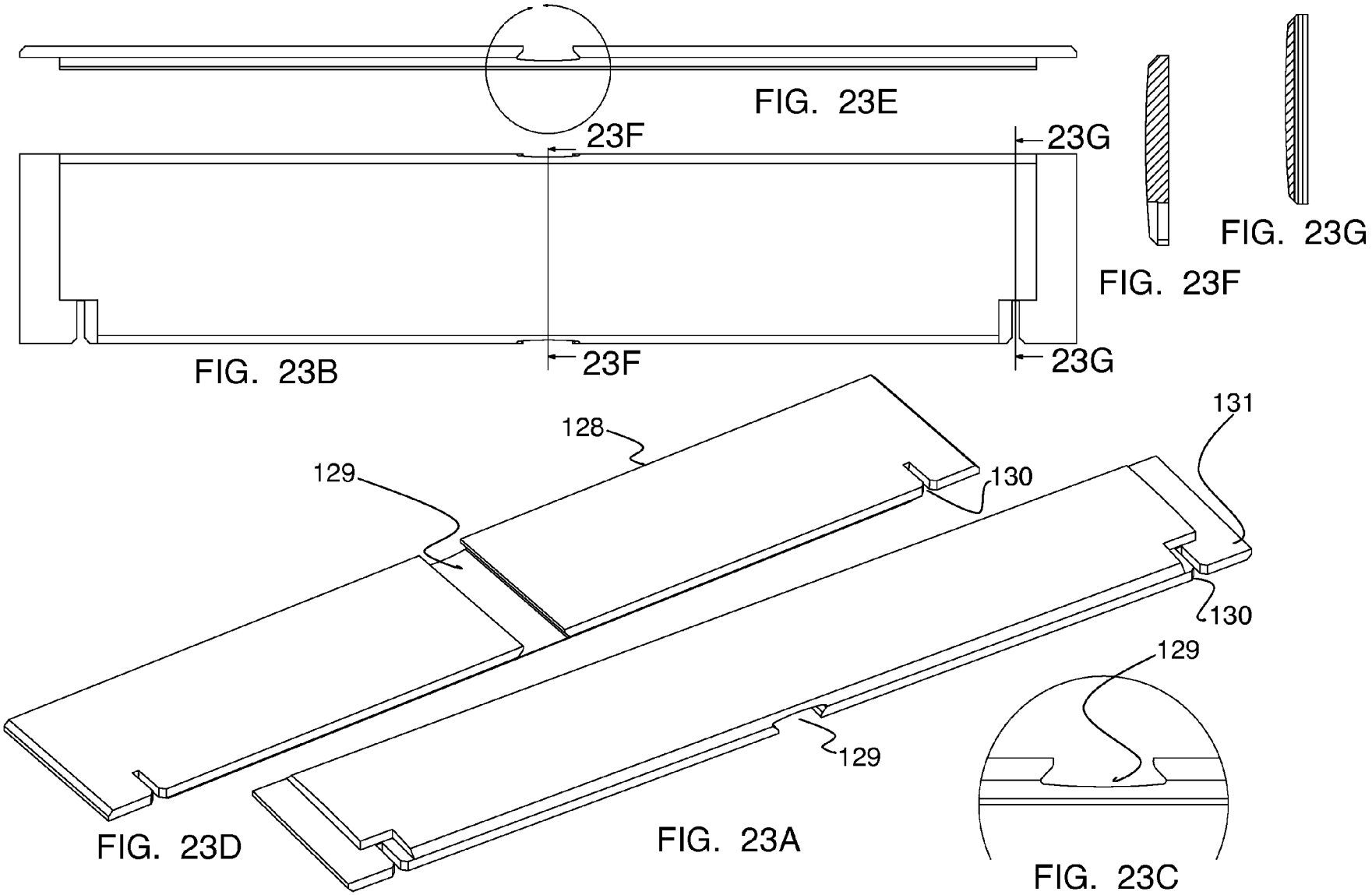

FIGS. 21A and 21B contain a plan view and elevation of an end board in accordance with this embodiment of the invention. The board (117) contains an axial socket (118) extending across the width of the board. The socket has a mouth narrower than the base so as to slidably receive and engage the runners (112) of the spine member in use. Slots (119) in the end portions (120) permit engagement with the projections (108) of the side rails in use. The axial opening of the central slot (118) faces in an opposite direction to the axially extending openings of the two slots (119). The end of the board (120) has a tongue (121) adapted to be received within the socket of the side rail in use.

FIGS. 22A-22G contain upper and lower plan views, elevations and cross sectional views of an alternative end board (122) for insertion onto the spine to complete assembly of the pallet. The board contains an axial slot (123) defining a socket for receipt onto the spine runner. The socket extends partially across the board including an abutment (127) to prevent sliding of the spine from the hinge (125) at the ends of the boards.

Slots (124) are located adjacent the ends of the board to permit engagement with the side rails as previously described. An aperture (126) is adapted to receive a bolt (not shown) to secure the board to the spine member.

FIGS. 23A-23G show a board member (128) having a tongue (131) with a slot (130) extending perpendicular to the board, parallel to the rail and outwardly towards the end of the pallet in use. A channel (129) extends across the width of the board (128) allowing the board to be slidably engaged on the runner of a spine member as shown in FIG. 20.

FIGS. 24 to 28E illustrate further embodiments of the invention.

Figure 24:
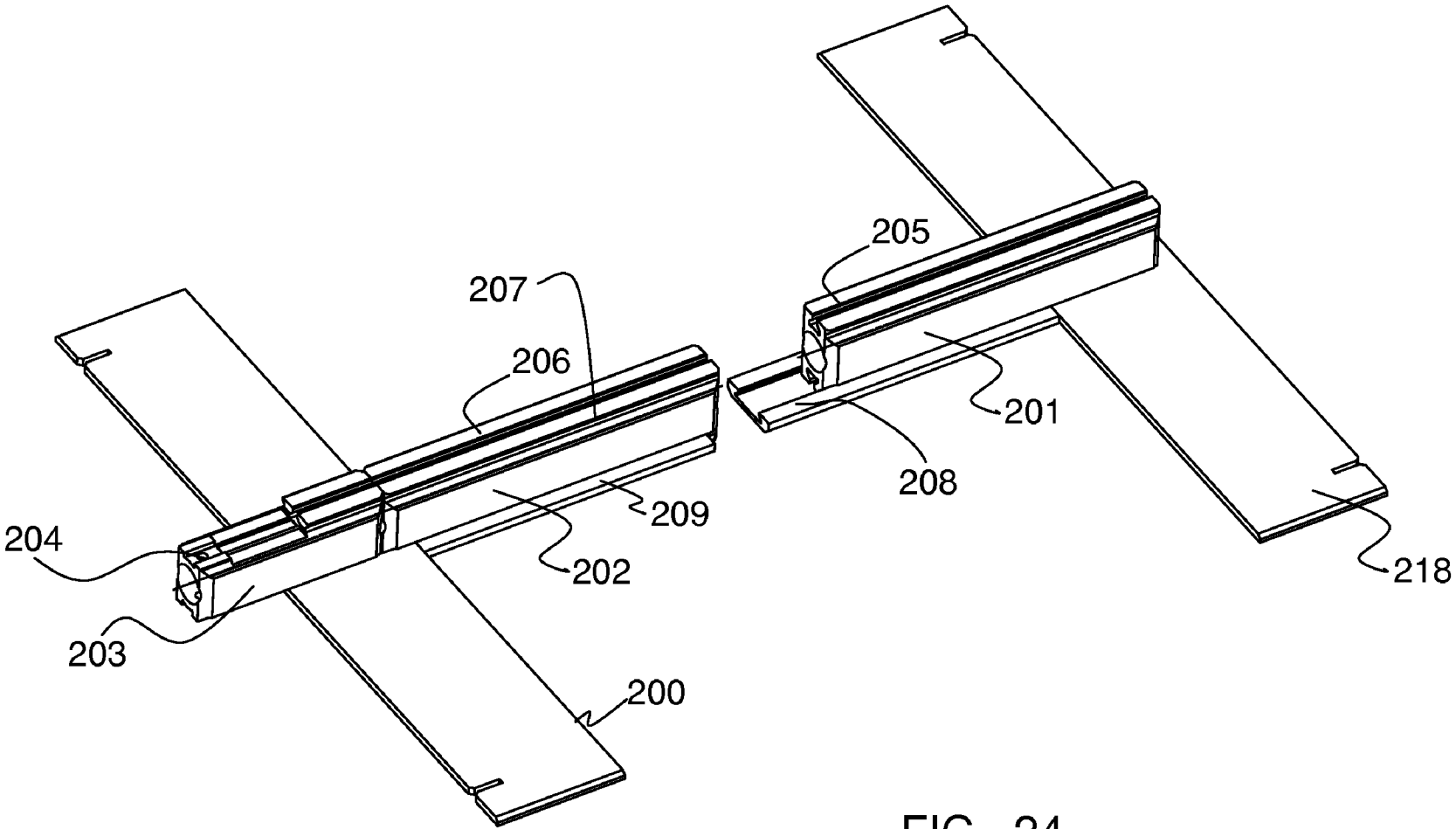
FIGS. 24 to 27 illustrate further embodiments of the invention.

FIG. 24 shows the first stage of assembly of an embodiment in which lower boards (200) are received onto the lower spine runners of spine portions (201,202). A locking spine portion (203) having an aperture (204) to receive a bolt is engaged in the end board. As with the previously described embodiment the spine members (201,202,203) provide continuous spine runners (205) comprising upwardly and downwardly pairs of ribs (206,207).

Protective spacers (208, 209) are inserted onto the lower spine runners between the boards (200). The protective spacers provide a load bearing, smooth surface which is generally co-planer with the lower ground engaging surfaces of the boards (200). In this way damage to the spine runners and occlusion of dirt are avoided.

Figure 25:
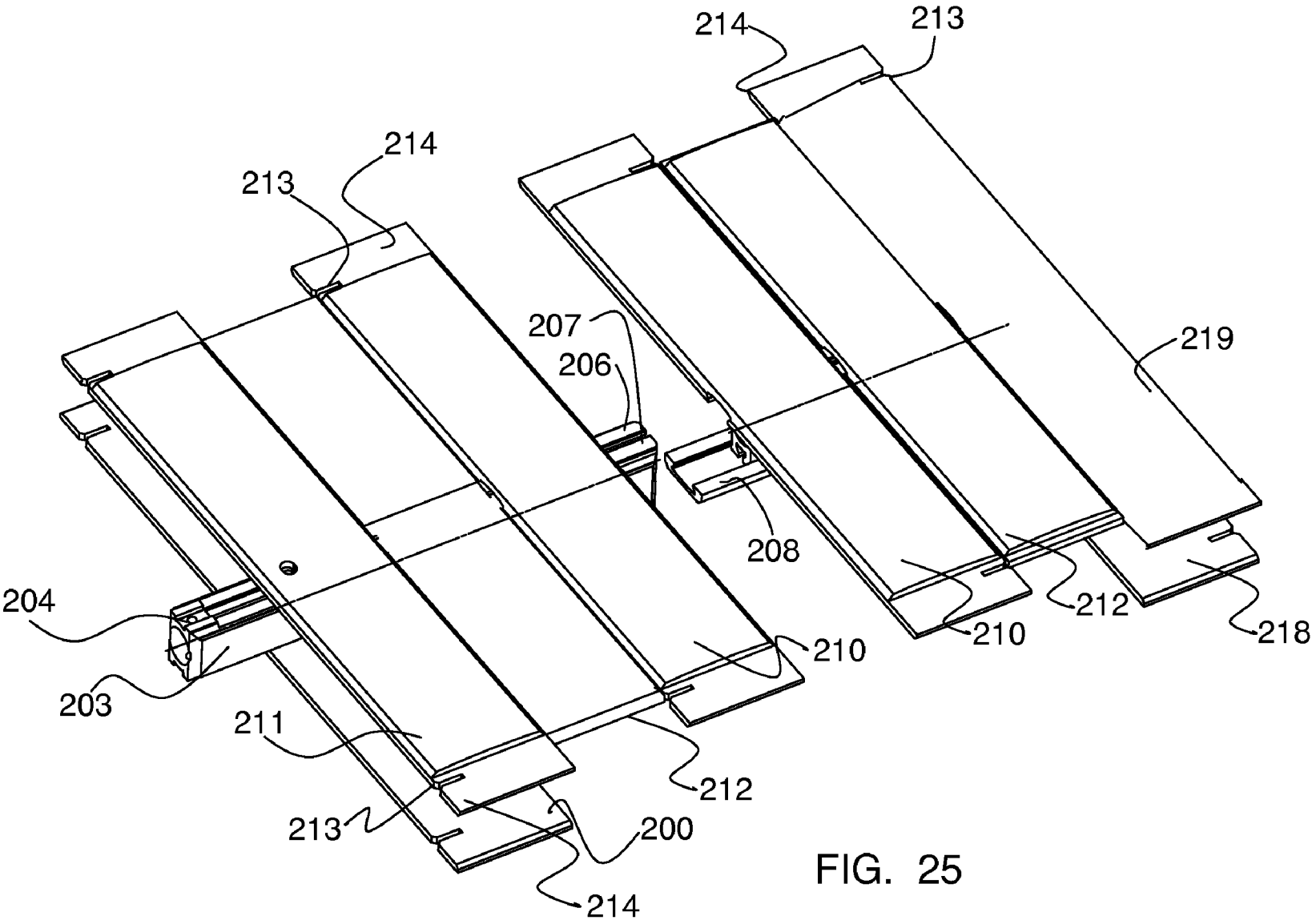

In FIG. 25 the above boards (210) have been inserted onto the upper spine runners (206,207) the upper boards (210) have tongues (214) with outwardly opening slots (213) extending parallel to the spine members as described with reference to the previous embodiments. Spacer boards (212) not having the slots (213) are located between pairs of boards (210). The end boards (219) may have a blind slot (213) as shown in FIG. 22 to receive and engage the end of the spine member.

Figure 26:
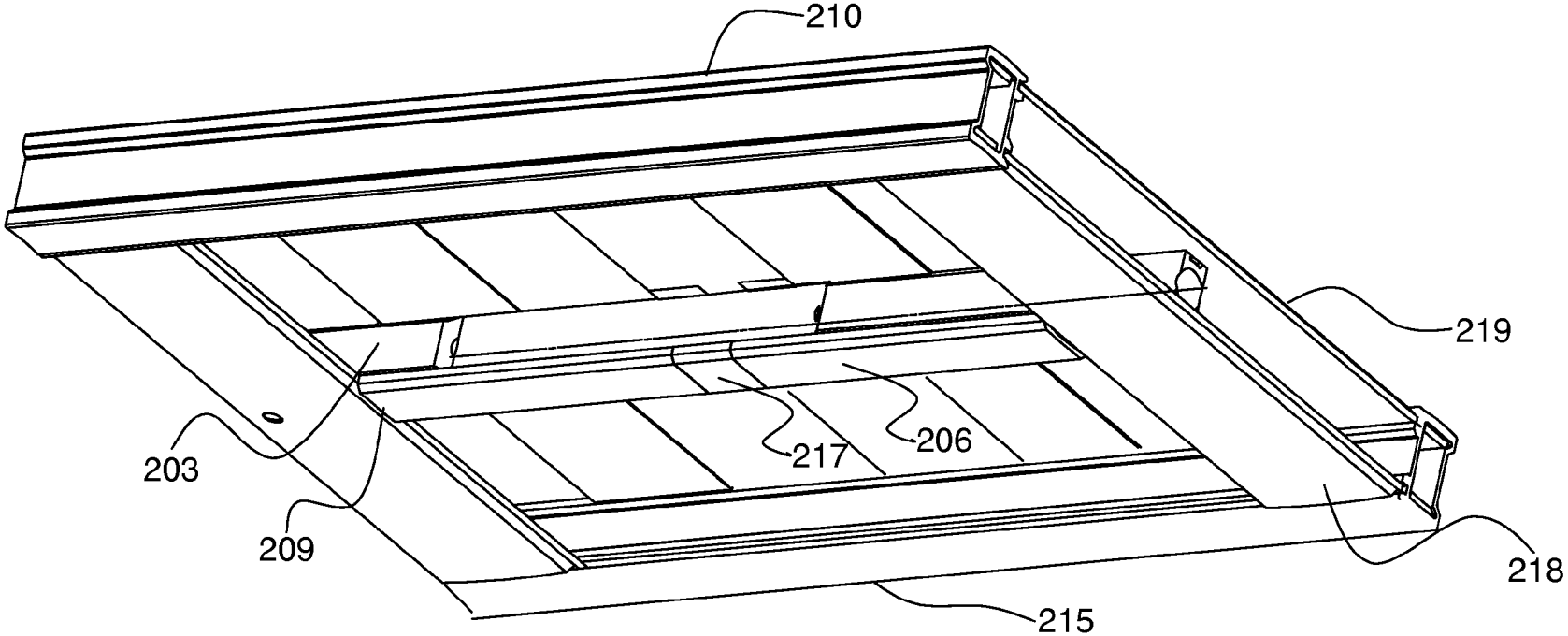

FIG. 26 is a view from below the assembled pallet. In FIG. 26 rails (215,216), lower end boards (218) and protective spacers (208,209,217) form a continuous planar ground engaging surface for the pallet.

Figure 27:
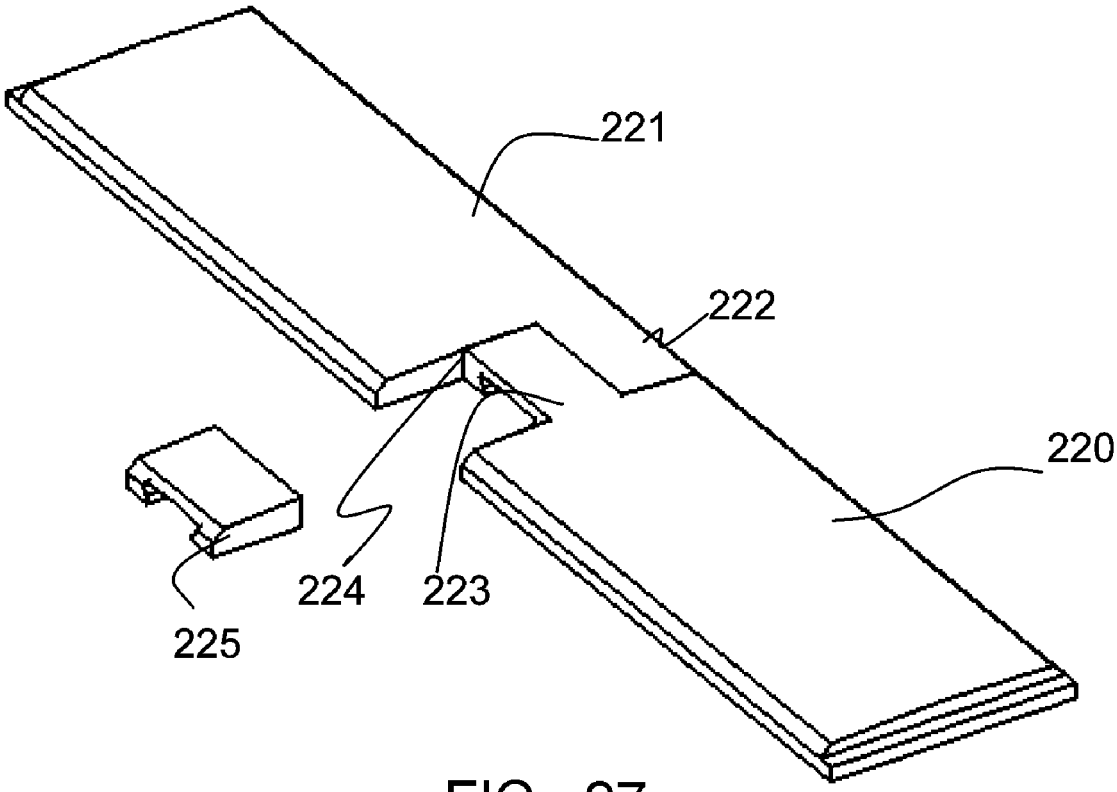
Figures 28A, 28B, 28C, 28D, 28E:
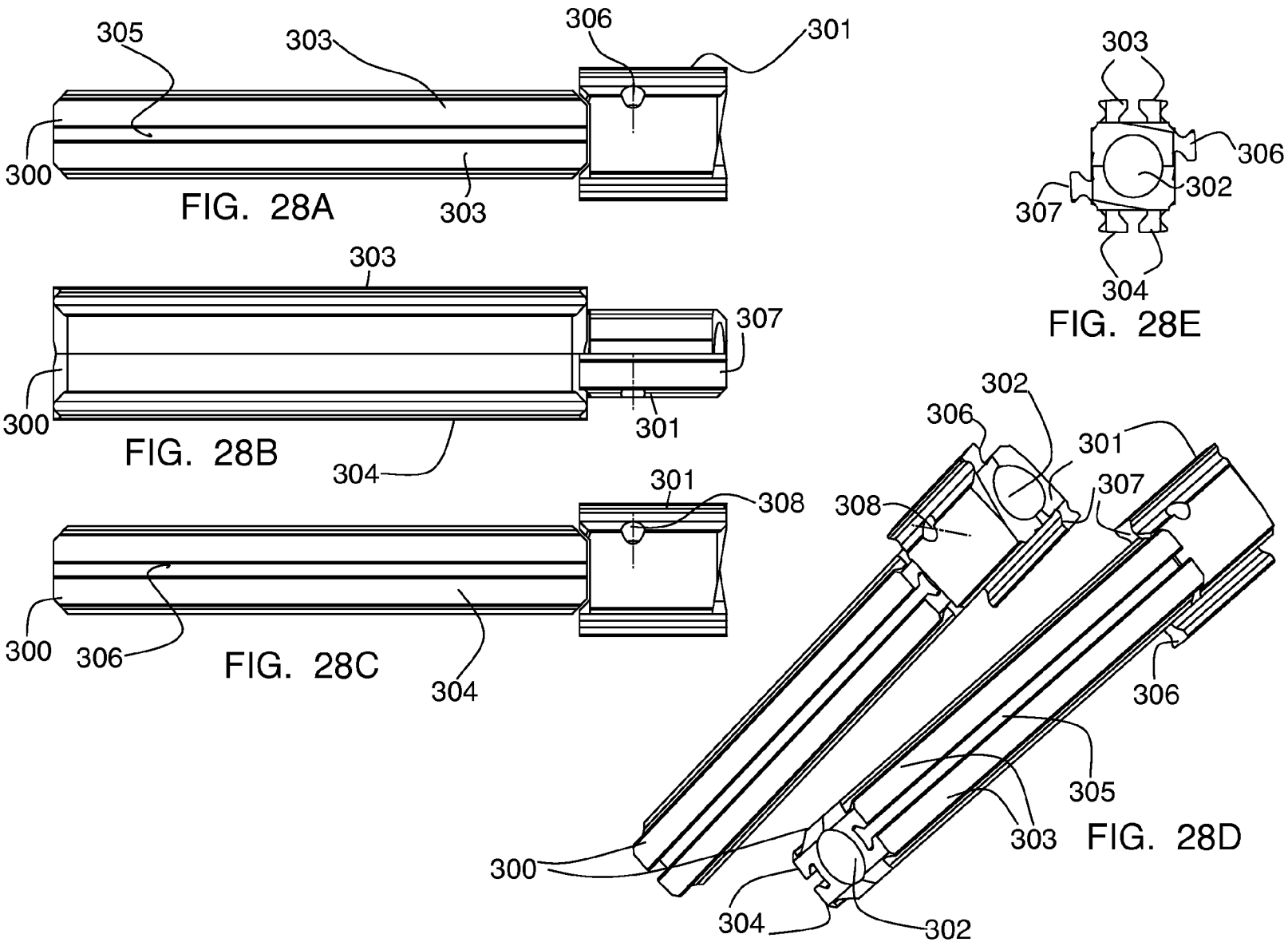
FIGS. 28A-28E illustrate the spine member of a further embodiment of the invention.

FIG. 27 illustrates an alternative segmented board in which two half portions (220,221) have interlocking central portions (222, 223) with hooked ends (224) for engagement on the spine runners. A locking sleeve (225) is inserted into the spine to retain the half portions in position after assembly.

Use of the segmented boards is advantageous in facilitating a final step of assembly of the pallet. The half board portion may be inserted into a central space remaining between the two H-shaped upper board arrays after the boards have been slid outwardly into their locked positions on the rails. In alternative embodiments and modes of assembly the use of segmented boards is not necessary.

FIGS. 28A-28E show an alternative locking member in accordance with this invention. A central portion of the spine (300) includes a rotatable locking portion (301). The locking portion may be mounted on a shaft or bearing to facilitate rotation axially of the shaft while maintaining a continuous axial cavity (302) through which a rope or other fixing may be passed in use. The spine member (300) carries an upwardly extending pair of parallel ribs (303) and a pair of parallel downwardly extending ribs (304) defining a channel (305, 306) between each pair of ribs as described with reference to the previous embodiments. The locking member (301) has a single upwardly extending rib or projection (306) and a single diametrically opposed downwardly facing projection (307). These may be twisted from a first position in which they are aligned parallel to the upper and lower ribs (303,304) to form a continuous surface upon which a board may slide during assembly or dismantling of the pallet, or a second locked position in which the ribs (306,307) are perpendicular so that movement of the board along the spine is prevented.

Rotation of locking member may be achieved by inserting a screwdriver or other elongate tool into an aperture (308) to allow twisting of the locking member between the locked and unlocked positions.

Figure 29:
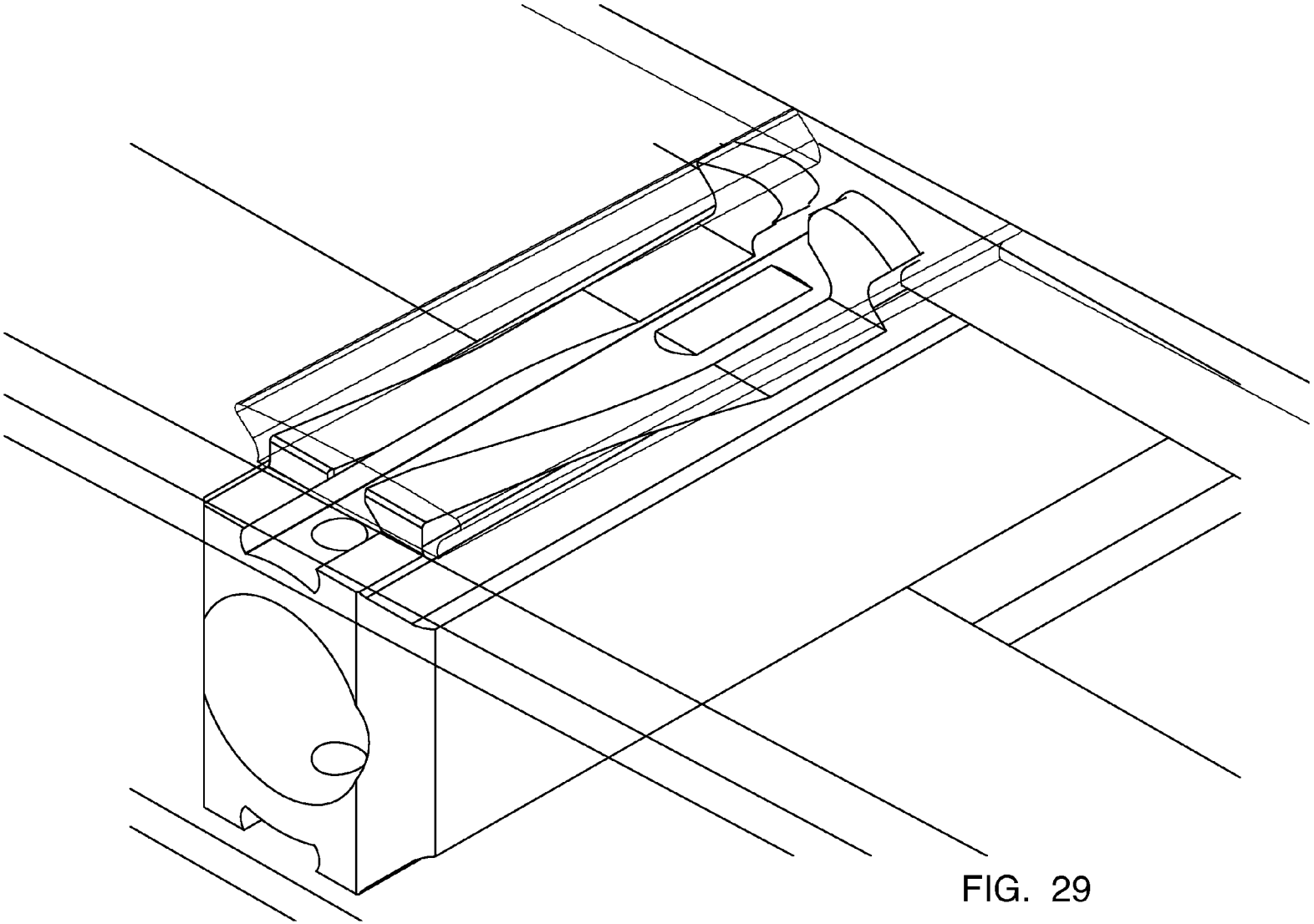
FIG. 29 illustrates an alternative locking arrangement.

FIG. 29 illustrates an alternative locking arrangement wherein a spring clip is used to secure the end board to the spine member. Any convenient arrangement of spring clip may be employed to secure the board to the spine but permitting release of the board if the pallet is to be dismantled. In this embodiment the clip has flanges extending in opposite directions on the ends to co-operate with complementary formulations on the end of the spine and underside of the board.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A pallet comprising:

a plurality of side rails, each said side rail including upper and lower runners;

a multiplicity of boards, each said board being adapted to extend between a said runner of two of the rails;

one or more spine members extending parallel to the rails, each said spine member including upper and lower spine runners;

each said board including a spine engaging portion adapted for sliding engagement with a respective said spine runner; and a locking member adapted when locked to prevent sliding disengagement of the boards from the respective spine runner;

each said board having two ends, the ends being formed with an engagement portion;

each said rail having a plurality of sockets, each said socket being adapted to receive and engage an engagement portion of a respective said board;

wherein the respective board may be moved parallel to the respective rail between an unlocked position wherein the board is disengaged from the rail and may be inserted into or removed from the socket and a locked position wherein the board is engaged with the rail preventing removal from the socket.

2. The pallet as claimed in claim 1, wherein each said side rail comprises a box section with the upper and lower runners facing inwardly of the pallet, each said runner comprising an array of sections wherein a channel extends along each said section with a rebate between adjacent said sections, the rebate having a dimension to receive and engage the respective board.

3. The pallet as claimed in claim 2, wherein the boards have projecting tongues adapted to be slidably received and engaged within the channels.

4. The pallet as claimed claim 1, wherein each of the side rails includes a plurality of inwardly extending projections and sockets located between adjacent projections, each said socket being adapted to receive the respective board inserted between the rails and further adapted so that the board, when received in the socket, may be moved slidably into a channel to engage the board and rail.

5. The pallet as claimed in claim 1, wherein each said board has a tongue at each end, the tongues extending transversely of the pallet towards the sockets in the respective rails; each said tongue including a formation defining an abutment extending parallel to the respective rail and adapted to engage a complementary formation of the rail as the board slides from the unlocked to the locked position.

6. The pallet as claimed in claim 5 wherein each said formation comprises a slot extending parallel to the rails and dimensioned to receive ribs integral with the respective rail and extending towards the sockets.

7. The pallet as claimed in claim 6 wherein the ribs are parallel sided parts of the box section of the rails.

8. The pallet as claimed in claim 1, wherein each said spine runner includes a pair of longitudinally extending ribs, the ribs defining a channel between the ribs, the channel and ribs being adapted to engage and retain a complementary formation of the spine engaging portion of each of the boards.

9. The pallet as claimed in claim 1, wherein the boards are adapted to slidably engage the spine runner from a first end thereof, the locking means being adapted to secure at least one of the boards slidably engaged on the first end of the respective spine runner.

10. The pallet as claimed in claim 1, wherein the spine member comprises two or more sections located end to end axially of the pallet.

11. The pallet as claimed in claim 1 wherein the boards are separated by spacer sections each said spacer section being located between a pair of adjacent said boards to provide a slatted upper and/or lower deck configuration.

12. The pallet as claimed in claim 11, wherein each said spine member has a longitudinal axis, a plurality of said spine runners extending axially of the spine member and one or more said locking members being rotatable about the axis; the one or more locking members including spine runner portions;

the one or more locking members being moveable from an unlocked position wherein the spine runner portion is aligned with the spine runners to form a continuous runner and a locked position wherein the locking member obstructs the spine runners so that the respective board may not be slidably disengaged from the runner.

* * * * *